US010544475B2

(12) United States Patent
Suwa et al.

(10) Patent No.: US 10,544,475 B2
(45) Date of Patent: Jan. 28, 2020

(54) HOT-STAMPED STEEL, COLD-ROLLED STEEL SHEET AND METHOD FOR PRODUCING HOT-STAMPED STEEL

(71) Applicant: NIPPON STEEL CORPORATION, Tokyo (JP)

(72) Inventors: Yoshihiro Suwa, Amagasaki (JP); Toshiki Nonaka, Tokai (JP); Koichi Sato, Tokai (JP); Manabu Naruse, Tokoname (JP); Yasunori Iwasa, Spanish Fort, AL (US); Yoshifumi Kobayashi, Obu (JP)

(73) Assignee: NIPPON STEEL CORPORATION, Tokyo (JP)

( * ) Notice: Subject to any disclaimer, the term of this patent is extended or adjusted under 35 U.S.C. 154(b) by 657 days.

(21) Appl. No.: 14/781,110

(22) PCT Filed: Mar. 27, 2014

(86) PCT No.: PCT/JP2014/058950

§ 371 (c)(1),
(2) Date: Sep. 29, 2015

(87) PCT Pub. No.: WO2014/162984

PCT Pub. Date: Oct. 9, 2014

(65) Prior Publication Data

US 2016/0060722 A1 Mar. 3, 2016

(30) Foreign Application Priority Data

Apr. 2, 2013 (JP) ..... 2013-076835

(51) Int. Cl.

| | |
|---|---|
| ***C22C 38/04*** | (2006.01) |
| ***C21D 8/02*** | (2006.01) |
| ***C22C 38/00*** | (2006.01) |
| ***C22C 38/02*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C23C 2/06*** | (2006.01) |
| ***C22C 38/06*** | (2006.01) |
| ***C23C 2/28*** | (2006.01) |
| ***C25D 7/06*** | (2006.01) |
| ***C22C 38/22*** | (2006.01) |
| ***C22C 38/28*** | (2006.01) |
| ***C22C 38/32*** | (2006.01) |

(Continued)

(52) U.S. Cl.

CPC ..... *C21D 8/0205* (2013.01); *C21D 6/004* (2013.01); *C21D 6/005* (2013.01); *C21D 6/008* (2013.01); *C21D 8/0226* (2013.01); *C21D 8/0236* (2013.01); *C21D 8/0278* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/28* (2013.01); *C22C 38/32* (2013.01); *C23C 2/06* (2013.01); *C23C 2/12* (2013.01); *C23C 2/28* (2013.01); *C25D 7/0614* (2013.01)

(58) Field of Classification Search

CPC ..... C21D 8/0205

See application file for complete search history.

(56) References Cited

U.S. PATENT DOCUMENTS

| | | | | |
|---|---|---|---|---|
| 2007/0023113 | A1 | 2/2007 | Ikeda et al. | |
| 2008/0000555 | A1* | 1/2008 | Nonaka | B21B 3/02 148/328 |
| 2011/0008546 | A1 | 1/2011 | Suzuki et al. | |

(Continued)

FOREIGN PATENT DOCUMENTS

| | | | |
|---|---|---|---|
| CN | 101903556 | A | 12/2010 |
| CN | 101932746 | A | 12/2010 |

(Continued)

OTHER PUBLICATIONS

Chinese Office Action and Search Report for Chinese Application No. 201480019720.0, dated May 4, 2016, with an English translation of the Search Report only.

(Continued)

*Primary Examiner* — Jophy S. Koshy

(74) *Attorney, Agent, or Firm* — Birch, Stewart, Kolasch & Birch, LLP

(57) ABSTRACT

A hot-stamped steel according to the present invention has a predetermined chemical composition, satisfies (5×[Si]+[Mn])/[C]>10 when [C] is the amount of C by mass %, [Si] is the amount of Si by mass %, and [Mn] is the amount of Mn by mass %, includes 40% to 95% ferrite and 5% to 60% martensite in area fraction, and optionally further includes 10% or less pearlite in area fraction, 5% or less retained austenite in volume fraction, and less than 40% bainite in area fraction. The total of the area fraction of ferrite and the area fraction of martensite is 60% or more, the hardness of martensite measured with a nanoindenter satisfies H2/H1<1.10 and σHM<20, and TS×λ which is product of tensile strength TS and hole expansion ratio λ is 50000 MPa·% or more.

6 Claims, 10 Drawing Sheets

(51) Int. Cl.

| | |
|---|---|
| ***C21D 6/00*** | (2006.01) |
| ***C23C 2/12*** | (2006.01) |

(56) References Cited

U.S. PATENT DOCUMENTS

| | | | |
|---|---|---|---|
| 2011/0030854 | A1 | 2/2011 | Matsuda et al. |
| 2011/0232807 | A1 | 9/2011 | Yoshinaga et al. |
| 2013/0273392 | A1 | 10/2013 | Nonaka et al. |
| 2014/0056753 | A1 | 2/2014 | Naitou et al. |

FOREIGN PATENT DOCUMENTS

| | | | |
|---|---|---|---|
| EP | 2128295 | A1 | 12/2009 |
| EP | 2157203 | A1 | 2/2010 |
| EP | 2562286 | A1 | 2/2013 |
| EP | 2719787 | A1 | 4/2014 |
| JP | 6-128688 | A | 5/1994 |
| JP | 11-189842 | A | 7/1999 |
| JP | 2000-319756 | A | 11/2000 |
| JP | 2001-355044 | A | 12/2001 |
| JP | 2005-120436 | A | 5/2005 |
| JP | 2005-256141 | A | 9/2005 |
| JP | 2007-16296 | A | 1/2007 |
| JP | 2010-65292 | A | 3/2010 |
| JP | WO 2012/081666 | A1 | 6/2012 |
| JP | 2013-14841 | A | 1/2013 |
| KR | 10-2001-0080778 | A | 8/2001 |
| KR | 10-2008-0017244 | A | 2/2008 |
| KR | 10-2011-0028643 | A | 3/2011 |
| KR | 10-2013-0002230 | A | 1/2013 |
| RU | 2423532 | C1 | 7/2011 |
| RU | 2439189 | C1 | 1/2012 |

OTHER PUBLICATIONS

Korean Notice of Allowance and English translation thereof, dated Sep. 22, 2016, for counterpart Korean Application No. 10-2015-7026285.

Russian Office Action for Application No. 2015141478 dated Feb. 17, 2017, with English language translation.

International Search Report, issued in PCT/JP2014/058950, dated Jun. 24, 2014.

Office Action, issued in TW 103111765, dated Apr. 15, 2015.

Written Opinion of the International Searching Authority, issued in PCT/JP2014/058950, dated Jun. 24, 2014.

Extened European Search Report, dated Dec. 1, 2016, for European Application No. 14778399.7.

* cited by examiner

HOT-STAMPED STEEL, COLD-ROLLED STEEL SHEET AND METHOD FOR PRODUCING HOT-STAMPED STEEL

TECHNICAL FIELD OF THE INVENTION

The present invention relates to a hot-stamped steel having an excellent formability (hole expansibility), an excellent chemical conversion treatment property, and an excellent plating adhesion after hot stamping, a cold-rolled steel sheet which is used as a material for the hot-stamped steel, and a method for producing a hot-stamped steel sheet.

Priority is claimed on Japanese Patent Application No. 2013-076835, filed Apr. 2, 2013, the content of which is incorporated herein by reference.

RELATED ART

At the moment, a steel sheet for a vehicle is required to be improved in terms of collision safety and to have a reduced weight. In such a situation, hot stamping (also called hot pressing, hot stamping, diequenching, press quenching or the like) is drawing attention as a method for obtaining a high strength. The hot stamping refers to a forming method in which a steel sheet is heated at a high temperature of, for example, 700° C. or more, then hot-formed so as to improve the formability of the steel sheet, and quenched by cooling after forming, thereby obtaining desired material qualities. As described above, a steel sheet used for a body structure of a vehicle is required to have a high press workability and a high strength. A steel sheet having a ferrite and martensite structure, a steel sheet having a ferrite and bainite structure, a steel sheet containing retained austenite in a structure or the like is known as a steel sheet having both press workability and high strength. Among these steel sheets, a multi-phase steel sheet having martensite dispersed in a ferrite base has a low yield ratio and a high tensile strength, and furthermore, has excellent elongation characteristics. However, the multi-phase steel sheet has a poor hole expansibility since stress concentrates at the interface between the ferrite and the martensite, and cracking is likely to initiate from the interface.

For example, Patent Documents 1 to 3 disclose the multi-phase steel sheet. In addition, Patent Documents 4 to 6 describe relationships between the hardness and formability of a steel sheet.

However, even with these techniques of the related art, it is difficult to obtain a steel sheet which satisfies the current requirements for a vehicle such as an additional reduction of the weight and more complicated shapes of a components. Various types of strength can be improved by adding elements such as Si and Mn as well as by changing the microstructure. However, when the amount of Si exceeds a constant amount as described below by adding Si, elongation or hole expansibility of steel may degrade. Furthermore, when the amount of Si or the amount of Mn increases, that chemical conversion treatment property or plating adhesion after hot stamping may degrade, which is not preferable.

PRIOR ART DOCUMENT

Patent Document

[Patent Document 1] Japanese Unexamined Patent Application, First Publication No. H6-128688

[Patent Document 2] Japanese Unexamined Patent Application, First Publication No. 2000-319756

[Patent Document 3] Japanese Unexamined Patent Application, First Publication No. 2005-120436

[Patent Document 4] Japanese Unexamined Patent Application, First Publication No. 2005-256141

[Patent Document 5] Japanese Unexamined Patent Application, First Publication No. 2001-355044

[Patent Document 6] Japanese Unexamined Patent Application, First Publication No. H11-189842

DISCLOSURE OF THE INVENTION

Problems to be Solved by the Invention

An object of the present invention is to provide a cold-rolled steel sheet capable of ensuring a strength and having a more favorable hole expansibility, an excellent chemical conversion treatment property, and an excellent plating adhesion when produced into a hot-stamped steel, a hot-stamped steel, and a method for producing the same hot-stamped steel.

Means for Solving the Problem

The present inventors carried out intensive studies regarding a cold-rolled steel sheet for hot stamping that ensured a strength after hot stamping (after quenching in a hot stamping), had an excellent formability (hole expansibility), and had an excellent chemical conversion treatment property and an excellent plating adhesion after hot stamping. As a result, it was found that, when an appropriate relationship is established among the amount of Si, the amount of Mn and the amount of C, a fraction of a ferrite and a fraction of a martensite in the steel sheet are set to predetermined fractions, and the hardness ratio (difference of a hardness) of the martensite between a surface portion of a sheet thickness and a central portion of the sheet thickness and the hardness distribution of the martensite in the central portion of the sheet thickness are set in specific ranges, it is possible to industrially produce a cold-rolled steel sheet for hot stamping capable of ensuring a formability, that is, a characteristic of $TS \times \lambda \geq 50000$ MPa·% that is a larger value than ever in terms of $TS \times \lambda$ that is a product of a tensile strength TS and a hole expansion ratio $\lambda$. Furthermore, it was found that, when this cold-rolled steel sheet is used for hot stamping, a hot-stamped steel having an excellent hole expansibility even after the hot stamping is obtained. In addition, it was also clarified that the limitation of segregation of MnS in the central portion of the sheet thickness of the cold-rolled steel sheet for hot stamping is also effective in improving the hole expansibility of the hot-stamped steel. In particular, it was found that, when the amount of Mn which is a main element for improving hardenability is reduced and the fraction or hardness of martensite decreases, hole expandability is maximized by the limitation of segregation of MnS and chemical conversion treatment property and plating adhesion are excellent after hot stamping. In addition, it was also found that, in cold-rolling, an adjustment of a fraction of a cold-rolling reduction to a total cold-rolling reduction (cumulative rolling reduction) from an uppermost stand to a third stand based on the uppermost stand within a specific range is effective in controlling a hardness of the martensite. Furthermore, the inventors have found a variety of aspects of the present invention as described below. In addition, it was found that the effects are not impaired even when a hot-dip galvanized layer, a galvannealed layer, an electrogalvanized layer and an aluminized layer are formed on the cold-rolled steel sheet.

(1) That is, according to a first aspect of the present invention, a hot-stamped steel includes, by mass %, C: 0.030% to 0.150%, Si: 0.010% to 1.000%, Mn: 0.50% or more and less than 1.50%, P: 0.001% to 0.060%, S: 0.001% to 0.010%, N: 0.0005% to 0.0100%, Al: 0.010% to 0.050%, and optionally at least one of B: 0.0005% to 0.0020%, Mo: 0.01% to 0.50%, Cr: 0.01% to 0.50%, V: 0.001% to 0.100%, Ti: 0.001% to 0.100%, Nb: 0.001% to 0.050%, Ni: 0.01% to 1.00%, Cu: 0.01% to 1.00%, Ca: 0.0005% to 0.0050%, REM: 0.00050% to 0.0050%, and a balance of Fe and impurities, in which, when [C] is the amount of C by mass %, [Si] is the amount of Si by mass %, and [Mn] is the amount of Mn by mass %, the following expression (A) is satisfied, the area fraction of a ferrite is 40% to 95% and the area fraction of a martensite is 5% to 60%, the total of the area fraction of the ferrite and the area fraction of the martensite is 60% or more, the hot-stamped steel optionally further includes one or more of a pearlite, a retained austenite, and a bainite, the area fraction of the pearlite is 10% or less, the volume fraction of the retained austenite is 5% or less, and the area fraction of the bainite is less than 40%, the hardness of the martensite measured with a nanoindenter satisfies the following expression (B) and the following expression (C), TS×λ which is a product of a tensile strength TS and a hole expansion ratio λ is 50000 MPa·% or more, $$(5\times[Si]+[Mn])/[C]>10 \quad \text{(A)},$$

$$H2/H1<1.10 \quad \text{(B)},$$

$$\sigma HM<20 \quad \text{(C), and}$$

the H1 is the average hardness of the martensite in a surface portion of a sheet thickness of the hot-stamped steel, the surface portion is an area having a width of 200 μm in a thickness direction from an outermost layer, the H2 is the average hardness of the martensite in a central portion of the sheet thickness of the hot-stamped steel, the central portion is an area having a width of 200 μm in the thickness direction at a center of the sheet thickness, and the σHM is the variance of the average hardness of the martensite in the central portion of the sheet thickness of the hot-stamped steel.

(2) In the hot-stamped steel according to the above (1), the area fraction of MnS existing in the hot-stamped steel and having an equivalent circle diameter of 0.1 μm to 10 μm may be 0.01% or less, and the following expression (D) may be satisfied, $$n2/n1<1.5 \quad \text{(D), and}$$

the n1 is an average number density per 10000 $\mu m^2$ of the MnS having an equivalent circle diameter of 0.1 μm to 10 μm in a ¼ portion of the sheet thickness of the hot-stamped steel, and the n2 is the average number density per 10000 $\mu m^2$ of the MnS having an equivalent circle diameter of 0.1 μm to 10 μm in the central portion of the sheet thickness of the hot-stamped steel.

(3) In the hot-stamped steel according to the above (1) or (2), a hot-dip galvanized layer may be formed on a surface thereof.

(4) In the hot-stamped steel according to the above (3), the hot-dip galvanized layer may be alloyed.

(5) In the hot-stamped steel according to the above (1) or (2), an electrogalvanized layer may be formed on a surface thereof.

(6) In the hot-stamped steel according to the above (1) or (2), an aluminized layer may be formed on a surface thereof.

(7) According to another aspect of the present invention, there is provided a method for producing a hot-stamped steel including casting a molten steel having a chemical composition according to the above (1) and obtaining a steel, heating the steel, hot-rolling the steel with a hot-rolling mill including a plurality of stands, coiling the steel after the hot-rolling, pickling the steel after the coiling, cold-rolling the steel with a cold-rolling mill including a plurality of stands after the pickling under a condition satisfying the following expression (E), annealing in which the steel is annealed under 700° C. to 850° C. after the cold-rolling and is cooled, temper-rolling the steel after the annealing, and hot stamping in which the steel is heated to a temperature range of 700° C. to 1000° C. after the temper-rolling, is hot stamped within the temperature range, and thereafter is cooled to a room temperature or more and 300° C. or less, $$1.5\times r1/r+1.2\times r2/r+r3/r>1.00 \quad \text{(E), and}$$

the ri (i=1, 2, 3) is an individual target cold-rolling reduction at an ith stand (i=1, 2, 3) based on an uppermost stand in the plurality of stands in the cold-rolling in unit %, and the r is the total cold-rolling reduction in the cold-rolling in unit %.

(8) In the method for producing the hot-stamped steel according to the above (7), the cold-rolling may be carried out under a condition satisfying the following expression (E'), $$1.20\geq 1.5\times r1/r+1.2\times r2/r+r3/r>1.00 \quad \text{(E'), and}$$

the ri (i=1, 2, 3) is the individual target cold-rolling reduction at the ith stand (i=1, 2, 3) based on the uppermost stand in the plurality of stands in the cold-rolling in unit %, and the r is the total cold-rolling reduction in the cold-rolling in unit %.

(9) In the method for producing the hot-stamped steel according to the above (7) or (8), when CT is a coiling temperature in the coiling in unit ° C, [C] is the amount of C in the steel by mass %, [Mn] is the amount of Mn in the steel by mass %, [Cr] is the amount of Cr in the steel by mass %, and [Mo] is the amount of Mo in the steel by mass %, the following expression (F) may be satisfied, $$560-474\times[C]-90\times[Mn]-20\times[Cr]-20\times[Mo]<CT<830-270\times[C]-90\times[Mn]70\times[Cr]-80\times[Mo] \quad \text{(F)}.$$

(10) In the method for producing the hot-stamped steel according to any one of the above (7) to (9), when T is the heating temperature in the heating in unit ° C., t is the in-furnace time in the heating in unit minute, [Mn] is the amount of Mn in the steel by mass %, and [S] is the amount of S in the steel by mass %, the following expression (G) may be satisfied, $$T\times\ln(t)/(1.7\times[Mn]+[S])>1500 \quad \text{(G)}.$$

(11) The method for producing the hot-stamped steel according to any one of the above (7) to (10) may further include galvanizing the steel between the annealing and the temper-rolling.

(12) The method for producing the hot-stamped steel according to the above (11) may further include alloying the steel between the galvanizing and the temper-rolling.

(13) The method for producing the hot-stamped steel according to any one of the above (7) to (10) may further include electrogalvanizing the steel after the temper-rolling.

(14) The method for producing the hot-stamped steel according to any one of the above (7) to (10) may further include aluminizing the steel between the annealing and the temper-rolling.

(15) According to another aspect of the present invention, a cold-rolled steel sheet includes, by mass %, C: 0.030% to 0.150%; Si: 0.010% to 1.000%; Mn: 0.50% or more and less than 1.50%; P: 0.001% to 0.060%; S: 0.001% to 0.010%; N: 0.0005% to 0.0100%; Al: 0.010% to 0.050%, and optionally at least one of B: 0.0005% to 0.0020%; Mo: 0.01% to 0.50%; Cr: 0.01% to 0.50%; V: 0.001% to 0.100%; Ti: 0.001% to 0.100%; Nb: 0.001% to 0.050%; Ni: 0.01% to 1.00%; Cu: 0.01% to 1.00%; Ca: 0.0005% to 0.0050% h; REM: 0.0005% to 0.0050%, and a balance of Fe and unavoidable impurities, in which, when [C] is the amount of C by mass %, [Si] is the amount of Si by mass %, and [Mn] is the amount of Mn by mass %, the following expression (A) is satisfied, the area fraction of a ferrite is 40% to 95% and the area fraction of a martensite is 5% to 60%, the total of the area fraction of the ferrite and the area fraction of the martensite is 60% or more, the cold-rolled steel sheet optionally further includes one or more of a pearlite, a retained austenite, and a bainite, the area fraction of the pearlite is 10% or less, the volume fraction of the retained austenite is 5% or less, and the area fraction of the bainite is less than 40%, the hardness of the martensite measured with a nanoindenter satisfies the following expression (H) and the following expression (I), TS×λ which is a product of the tensile strength TS and the hole expansion ratio λ is 50000 MPa·% or more, $$(5\times[Si]+[Mn])/[C]>10 \quad \text{(A)},$$

$$H20/H10<1.10 \quad \text{(H)},$$

$$\sigma HM0<20 \quad \text{(I), and}$$

the H10 is the average hardness of the martensite in a surface portion of a sheet thickness, the surface portion is an area having a width of 200 μm in a thickness direction from an outermost layer, the H20 is the average hardness of the martensite in a central portion of the sheet thickness, the central portion is an area having a width of 200 μm in the thickness direction at a center of the sheet thickness, and the σHM0 is the variance of the average hardness of the martensite in the central portion of the sheet thickness.

(16) In the cold-rolled steel sheet according to the above (15), the area fraction of MnS existing in the cold-rolled steel sheet and having an equivalent circle diameter of 0.1 μm to 10 μm may be 0.01% or less, the following expression (J) is satisfied, $$n20/n10<1.5 \quad \text{(J), and}$$

the n10 is an average number density per 10000 $\mu m^2$ of the MnS having an equivalent circle diameter of 0.1 μm to 10 μm in a ¼ portion of the sheet thickness, and the n20 is an average number density per 10000 $\mu m^2$ of the MnS having an equivalent circle diameter of 0.1 μm to 10 μm in the central portion of the sheet thickness.

(17) In the cold-rolled steel sheet according to the above (15) or (16), a hot-dip galvanized layer may be formed on a surface thereof.

(18) In the cold-rolled steel sheet according to the above (17), the hot-dip galvanized layer may be alloyed.

(19) In the cold-rolled steel sheet according to the above (15) or (16), an electrogalvanized layer may be formed on a surface thereof.

(20) In the cold-rolled steel sheet according to the above (15) or (16), an aluminized layer may be formed on a surface thereof.

Effects of the Invention

According to the above-described aspect of the present invention, since an appropriate relationship is established among the amount of C, the amount of Mn and the amount of Si, and the hardness of the martensite measured with a nanoindenter is set to an appropriate value in the cold-rolled steel sheet before hot stamping and hot-stamped steel after hot stamping, it is possible to obtain a more favorable hole expansibility in the hot-stamped steel and chemical conversion treatment property and plating adhesion are favorable even after hot stamping.

EMBODIMENTS OF THE INVENTION

Figure 1:
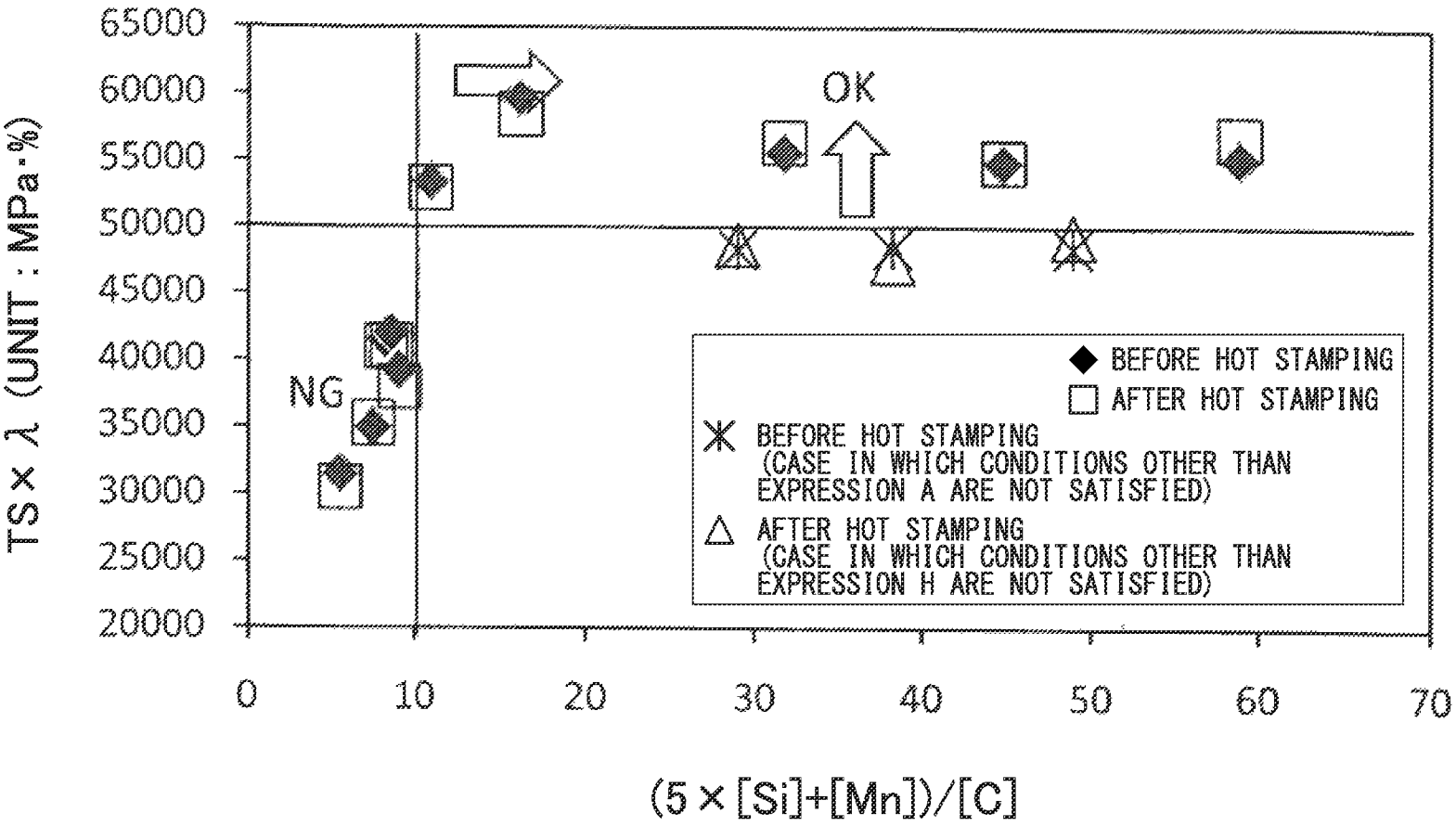
FIG. 1 is a graph showing the relationship between (5×[Si]+[Mn])/[C] and TS×λ in a cold-rolled steel sheet for hot stamping before quenching in the hot stamping and a hot-stamped steel.

As described above, it is important to establish an appropriate relationship among the amount of Si, the amount of Mn and the amount of C and provide an appropriate hardness to martensite in a predetermined position in a hot-stamped steel (or a cold-rolled steel sheet) in order to improve hole expansibility of the hot-stamped steel. Thus far, there have been no studies regarding the relationship between the hole expansibility or the hardness of the martensite in a hot-stamped steel.

Herein, reasons for limiting a chemical composition of a hot-stamped steel according to an embodiment of the present invention (in some cases, also referred to as a hot-stamped steel according to the present embodiment) and steel used for manufacture thereof will be described. Hereinafter, "%" that is the units of the amount of an individual component indicates "mass %".

C: 0.030% to 0.150%

C is an important element to strengthen the martensite and increase the strength of the steel. When the amount of C is less than 0.030%, it is not possible to sufficiently increase the strength of the steel. On the other hand, when the amount of C exceeds 0.150%, degradation of the ductility (elongation) of the steel becomes significant. Therefore, the range of the amount of C is set to 0.030% to 0.150%. In a case in which there is a demand for high hole expansibility, the amount of C is desirably set to 0.100% or less.

Si: 0.010% to 1.000%

Si is an important element for suppressing a formation of harmful carbide and obtaining a multi-phase structure mainly including a ferrite structure and a balance of the martensite. However, in a case in which the amount of Si exceeds 1.000%, the elongation or hole expansibility of the steel degrades, and a chemical conversion treatment property or plating adhesion after hot stamping also degrades. Therefore, the amount of Si is set to 1.000% or less. In addition, while Si is added for deoxidation, a deoxidation effect is not sufficient when the amount of Si is less than 0.010%. Therefore, the amount of Si is set to 0.010% or more.

Al: 0.010% to 0.050%

Al is an important element as a deoxidizing agent. To obtain the deoxidation effect, the amount of Al is set to 0.010% or more. On the other hand, even when Al is excessively added, the above-described effect is saturated, and conversely, the steel becomes brittle. Therefore, the amount of Al is set to be in a range of 0.010% to 0.050%.

Mn: 0.50% or more and less than 1.50%

Mn is an important element for increasing a hardenability of the steel and strengthening the steel. However, when the amount of Mn is less than 0.50%, it is not possible to sufficiently increase the strength of the steel. On the other hand, Mn is selectively oxidized on a surface in a similar manner with Si, and thereby chemical conversion treatment property or plating adhesion after hot stamping degrades. As a result of studies by the inventors, it was found that when the amount of Mn is 1.50% or more, plating adhesion degrades. Therefore, in the embodiment, the amount of Mn is set to less than 1.5%. It is more preferable that the upper limit of the amount of Mn be 1.45%. Therefore, the amount of Mn is set to be in a range of 0.50% to less than 1.50%. In a case in which there is a demand for high elongation, the amount of Mn is desirably set to 1.00% or less.

P: 0.001% to 0.060%

In a case in which the amount is large, P segregates at a grain boundary, and deteriorates the local ductility and weldability of the steel. Therefore, the amount of P is set to 0.060% or less. On the other hand, since an unnecessary decrease of P leads to an increase in the cost of refining, the amount of P is desirably set to 0.001% or more.

S: 0.001% to 0.010%

S is an element that forms MnS and significantly deteriorates the local ductility or weldability of the steel. Therefore, the upper limit of the amount of S is set to 0.010%. In addition, in order to reduce refining costs, the lower limit of the amount of S is desirably set to 0.001%.

N: 0.0005% to 0.0100%

N is an important element to precipitate AlN and the like and to refine crystal grains. However, when the amount of N exceeds 0.0100%, a solute N (a solute nitrogen) remains and the ductility of the steel is degraded. Therefore, the amount of N is set to 0.0100% or less. Due to a problem of refining costs, the lower limit of the amount of N is desirably set to 0.0005%.

The hot-stamped steel according to the embodiment has a basic composition including the above-described elements, Fe and unavoidable impurities as a balance, but may further contain any one or more elements selected from Nb, Ti, V, Mo, Cr, Ca, REM (rare earth metal), Cu, Ni and B as elements that have thus far been used in amounts that are within the below-described ranges to improve the strength, to control a shape of a sulfide or an oxide, and the like. Even when the hot-stamped steel or cold-rolled steel sheet does not include Nb, Ti, V, Mo, Cr, Ca, REM, Cu, Ni, and B, various properties of the hot-stamped steel or cold-rolled steel sheet can be improved sufficiently. Therefore, the lower limits of the amounts of Nb, Ti, V, Mo, Cr, Ca, REM, Cu, Ni, and B are 0%.

Nb, Ti and V are elements that precipitate fine carbonitride and strengthen the steel. In addition, Mo and Cr are elements that increase hardenability and strengthen the steel. To obtain these effects, the steel desirably contains Nb: 0.001% or more, Ti: 0.001% or more, V: 0.001% or more, Mo: 0.01% or more, and Cr: 0.01% or more. However, even when Nb: more than 0.050%, Ti: more than 0.100%, V: more than 0.100%, Mo: more than 0.50%, or Cr: more than 0.50% are contained, the strength-increasing effect is saturated, and there is a concern that the degradation of the elongation or the hole expansibility may be caused.

The steel may further contain Ca in a range of 0.0005% to 0.0050%. Ca and rare earth metal (REM) control the shape of sulfides or oxides and improve the local ductility or the hole expansibility. To obtain this effect using the Ca, it is preferable to add 0.0005% or more Ca. However, since there is a concern that an excessive addition may deteriorate workability, the upper limit of the amount of Ca is set to 0.0050%. For the same reason, for the rare earth metal (REM) as well, it is preferable to set the lower limit of the amount to 0.0005% and the upper limit of the amount to 0.0050%.

The steel may further contain Cu: 0.01% to 1.00%, Ni: 0.01% to 1.00% and B: 0.0005% to 0.0020%. These elements also can improve the hardenability and increase the strength of the steel. However, to obtain the effect, it is preferable to contain Cu: 0.01% or more, Ni: 0.01% or more and B: 0.0005% or more. In a case in which the amounts are equal to or less than the above-described values, the effect that strengthens the steel is small. On the other hand, even when Cu: more than 1.00%, Ni: more than 1.00% and B: more than 0.0020% are added, the strength-increasing effect is saturated, and there is a concern that the ductility may degrade.

In a case in which the steel contains B, Mo, Cr, V, Ti, Nb, Ni, Cu, Ca and REM, one or more elements are contained. The balance of the steel is composed of Fe and unavoidable impurities. Elements other than the above-described elements (for example, Sn, As and the like) may be further contained as unavoidable impurities as long as the elements do not impair characteristics. Furthermore, when B, Mo, Cr, V, Ti, Nb, Ni, Cu, Ca and REM are contained in amounts that are less than the above-described lower limits, the elements are treated as unavoidable impurities.

In addition, in the hot-stamped steel according to the embodiment, as shown in FIG. 1, when the amount of C (mass %), the amount of Si (mass %) and the amount of Mn (mass %) are represented by [C], [Si] and [Mn] respectively, it is important to satisfy the following expression (A).

$$(5\times[Si]+[Mn])/[C]>10 \quad (A)$$

To satisfy a condition of TS×λ≥50000 MPa·%, the above expression (A) is preferably satisfied. When the value of (5×[Si]+[Mn])/[C] is 10 or less, it is not possible to obtain a sufficient hole expansibility. This is because, when the amount of C is large, the hardness of a hard phase becomes too high, a hardness difference (ratio of the hardness) between the hard phase and a soft phase becomes great, and therefore the λ value deteriorates, and, when the amount of Si or the amount of Mn is small, TS becomes low. Regarding the value of (5×[Si]+[Mn])/[C], since the value does not change even after hot stamping as described above, the expression is preferably satisfied when the cold-rolled steel sheet is produced.

Figure 2A:
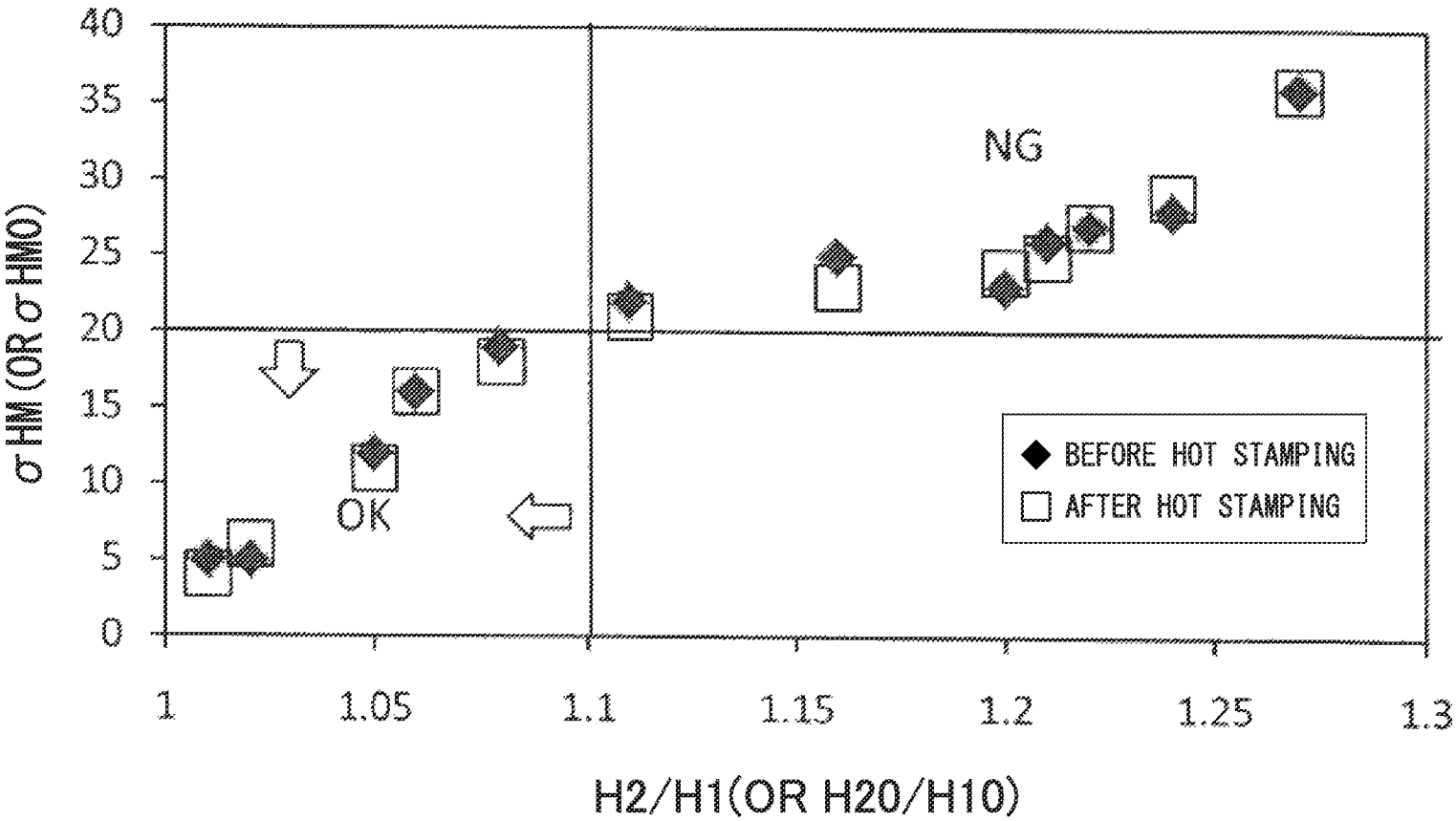
FIG. 2A is a graph showing the foundation of an expression (B) and is a graph showing the relationship between an H20/H10 and a σHM0 in the cold-rolled steel sheet for hot stamping before quenching in the hot stamping and the relationship between H2/H1 and σHM in the hot-stamped steel.
Figure 2B:
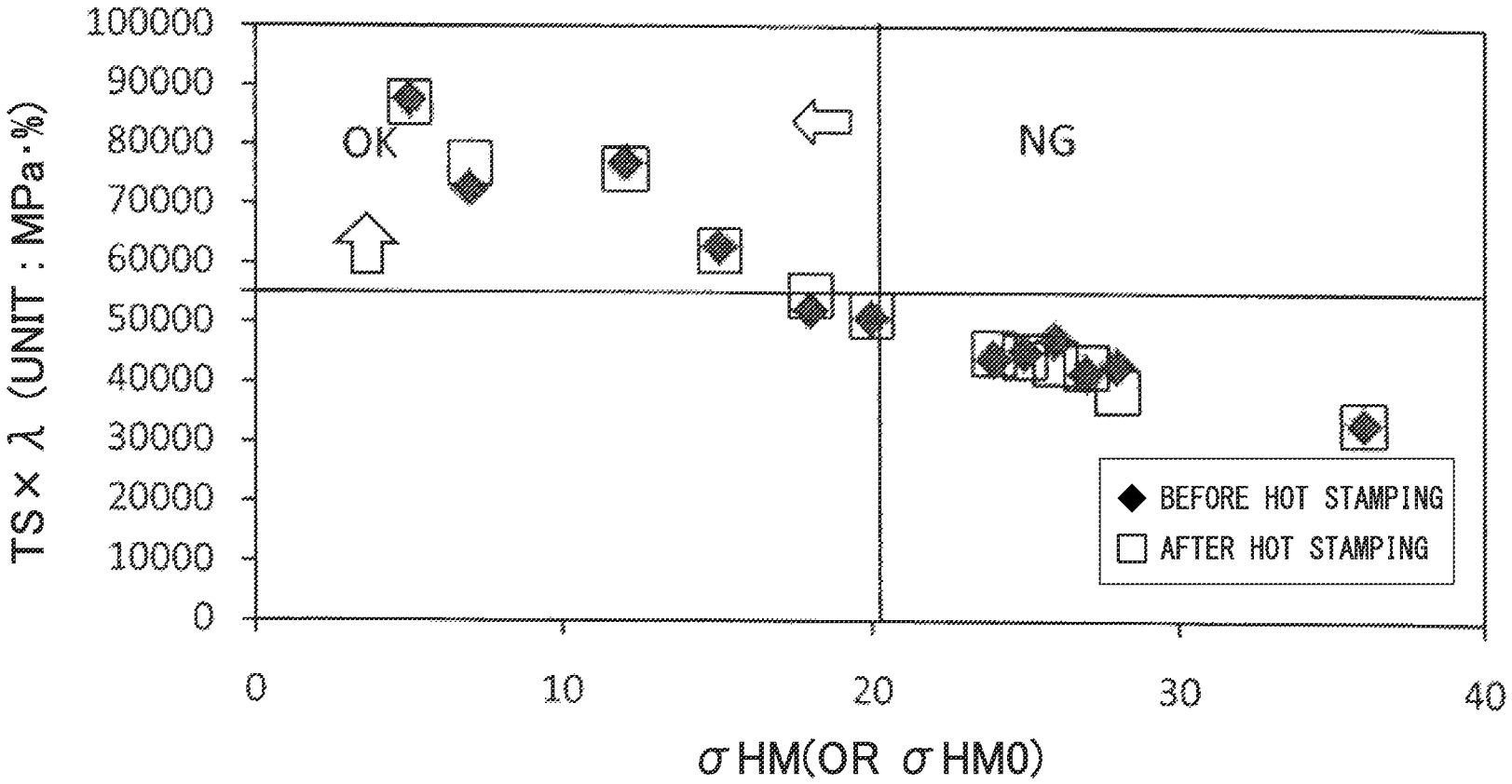
FIG. 2B is a graph showing the foundation of an expression (C) and is a graph showing the relationship between σHM0 and TS×) in the cold-rolled steel sheet for hot stamping before quenching in the hot stamping and the relationship between σHM and TS×λ in the hot-stamped steel.

Generally, it is the martensite rather than the ferrite to dominate the formability (hole expansibility) in a dual-phase steel (DP steel). As a result of intensive studies by the inventors regarding the hardness of martensite, it was clarified that, when the hardness difference (the ratio of the hardness) of the martensite between a surface portion of a sheet thickness and a central portion of the sheet thickness, and the hardness distribution of the martensite in the central portion of the sheet thickness are in a predetermined state in a phase before quenching in the hot stamping, the state is almost maintained even after hot stamping as shown in FIGS. 2A and 2B, and the formability such as elongation or hole expansibility becomes favorable. This is considered to be because the hardness distribution of the martensite formed before quenching in the hot stamping still has a significant effect even after hot stamping, and alloy elements concentrated in the central portion of the sheet thickness still hold a state of being concentrated in the central portion of the sheet thickness even after hot stamping. That is, in the cold-rolled steel sheet before quenching in the hot stamping, in a case in which the hardness ratio between the martensite in the surface portion of the sheet thickness and the martensite in the central portion of the sheet thickness is great, or a variance of the hardness of the martensite is great, the same tendency is exhibited even after hot stamping. As shown in FIGS. 2A and 2B, the hardness ratio between the surface portion of the sheet thickness and the central portion of the sheet thickness in the cold-rolled steel sheet according to the embodiment before quenching in the hot stamping and the hardness ratio between the surface portion of the sheet thickness and the central portion of the sheet thickness in the hot-stamped steel according to the embodiment are almost the same. In addition, similarly, the variance of the hardness of the martensite in the central portion of the sheet thickness in the cold-rolled steel sheet according to the embodiment before quenching in the hot stamping and the variance of the hardness of the martensite in the central portion of the sheet thickness in the hot-stamped steel according to the embodiment are almost the same. Therefore, the formability of the cold-rolled steel sheet according to the embodiment is similarly excellent to the formability of the hot-stamped steel according to the embodiment.

In addition, regarding the hardness of the martensite measured with an nanoindenter manufactured by Hysitron Corporation, the inventors found that the fulfillments of the following expression (B) and the following expression (C) are advantageous to the hole expansibility of the hot-stamped steel. The fulfillments of the expression (H) and the expression (I) are also advantageous in the same manner. Here, "H1" is the average hardness of the martensite in the surface portion of the sheet thickness that is within an area having a width of 200 μm in a thickness direction from an outermost layer of the hot-stamped steel, "H2" is the average hardness of the martensite in an area having a width of ±100 μm in the thickness direction from the central portion of the sheet thickness in the central portion of the sheet thickness in the hot-stamped steel, and "σHM" is the variance of the hardness of the martensite in an area having a width of ±100 μm in the thickness direction from the central portion of the sheet thickness in the hot-stamped steel. In addition, "H10" is the hardness of the martensite in the surface portion of the sheet thickness in the cold-rolled steel sheet before quenching in the hot stamping, "H20" is the hardness of the martensite in the central portion of the sheet thickness, that is, in an area having a width of 200 μm in the thickness direction in a center of the sheet thickness in the cold-rolled steel sheet before quenching in the hot stamping, and "σHM0" is the variance of the hardness of the martensite in the central portion of the sheet thickness in cold-rolled steel sheet before quenching in the hot stamping. The H1, H10, H2, H20, σHM and σHM0 are obtained from 300-point measurements for each. An area having a width of ±100 μm in the thickness direction from the central portion of the sheet thickness refers to an area having a center at the center of the sheet thickness and having a width of 200 μm in the thickness direction.

$$H2/H1<1.10 \quad (B)$$

$$\sigma HM<20 \quad (C)$$

$$H20/H10<1.10 \quad (H)$$

$$\sigma HM0<20 \quad (I)$$

In addition, here, the variance is a value obtained using the following expression (K) and indicating a distribution of the hardness of the martensite.

$$\sigma HM=(1/n)\times\Sigma[n,i=1](x_{ave}-x_i)^2 \quad (K)$$

$x_{ave}$ is the average value of the hardness, and $x_i$ is an ith hardness.

A value of H2/H1 of 1.10 or more represents that the hardness of the martensite in the central portion of the sheet thickness is 1.10 or more times the hardness of the martensite in the surface portion of the sheet thickness, and, in this case, σHM becomes 20 or more even after hot stamping as shown in FIG. 2A. When the value of the H2/H1 is 1.10 or more, the hardness of the central portion of the sheet thickness becomes too high, TS×λ becomes less than 50000 MPa·% as shown in FIG. 2B, and a sufficient formability cannot be obtained both before quenching (that is, before hot stamping) and after quenching (that is, after hot stamping). Furthermore, theoretically, there is a case in which the lower limit of the H2/H1 becomes the same in the central portion of the sheet thickness and in the surface portion of the sheet thickness unless a special thermal treatment is carried out; however, in an actual production process, when considering productivity, the lower limit is, for example, approximately 1.005. What has been described above regarding the value of H2/H1 shall also apply in a similar manner to the value of H20/H10.

In addition, the variance σHM being 20 or more even after hot stamping indicates that a scattering of the hardness of the martensite is large, and portions in which the hardness is too high locally exist. In this case, TS×λ becomes less than 50000 MPa·% as shown in FIG. 2B, and a sufficient hole expansibility of the hot-stamped steel cannot be obtained.

What has been described above regarding the value of the σHM shall also apply in a similar manner to the value of the σHM0.

In the hot-stamped steel according to the embodiment, the area fraction of ferrite is 40% to 95%. When the area fraction of ferrite is less than 40%, a sufficient elongation or a sufficient hole expansibility cannot be obtained. On the other hand, when the area fraction of the ferrite exceeds 95%, the martensite becomes insufficient, and a sufficient strength cannot be obtained. Therefore, the area fraction of ferrite in the hot-stamped steel is set to 40% to 95%. In addition, the hot-stamped steel also includes martensite, the area fraction of martensite is 5% to 60%, and the total of the area fraction of ferrite and the area fraction of martensite is 60% or more. All or principal portions of the hot-stamped steel are occupied by ferrite and martensite, and furthermore, one or more of bainite and retained austenite may be included in the hot-stamped steel. However, when retained austenite remains in the hot-stamped steel, a secondary working brittleness and a delayed fracture characteristic are likely to degrade. Therefore, it is preferable that retained austenite is substantially not included; however, unavoidably, 5% or less of retained austenite in a volume fraction may be included. Since pearlite is a hard and brittle structure, it is preferable not to include pearlite in the hot-stamped steel; however, unavoidably, up to 10% of pearlite in an area fraction may be included. Furthermore, the amount of bainite may be 40% at most in an area fraction with respect to a region excluding ferrite and martensite. Here, ferrite, bainite and pearlite were observed through Nital etching, and martensite was observed through Le pera etching. In both cases, a ¼ portion of the sheet thickness was observed at a magnification of 1000 times. The volume fraction of retained austenite was measured with an X-ray diffraction apparatus after polishing the steel sheet up to the ¼ portion of the sheet thickness. The ¼ portion of the sheet thickness refers to a portion ¼ of the thickness of the steel sheet away from a surface of the steel sheet in a thickness direction of the steel sheet in the steel sheet.

In the embodiment, the hardness of the martensite is specified by a hardness obtained using a nanoindenter under the following conditions.

- Magnification for observing indentation: ×1000
- Visual field for observation: height of 90 μm and width of 120 μm
- Indenter shape: Berkovich-type three-sided pyramid diamond indenter
- Compression load: 500 μN (50 mgf)
- Loading time for indenter compression: 10 seconds
- Unloading time period for indenter compression: 10 seconds (the indenter is not kept at a position of the maximum load.)

A relationship between compression depth and load is obtained under the above condition, and hardness is calculated from the relationship. The hardness can be calculated by a conventional method. The hardness is measured at 10 positions, the hardness of martensite is obtained by an arithmetic average for the 10 hardness values. The individual positions for measurement are not particularly limited as long as the positions are within martensite grains. However, the distance between positions for measurement must be 5 μm or longer Since an indentation formed in an ordinary Vickers hardness test is larger than the martensite, according to the Vickers hardness test, while a macroscopic hardness of the martensite and peripheral structures thereof (ferrite and the like) can be obtained, it is not possible to obtain the hardness of the martensite itself. Since the formability (hole expansibility) is significantly affected by the hardness of the martensite itself, it is difficult to sufficiently evaluate the formability only with a Vickers hardness. On the contrary, in the embodiment, since the distribution state of hardness is given based on the hardness of the martensite in the hot-stamped steel measured with the nanoindenter, it is possible to obtain an extremely favorable formability.

Figure 3:
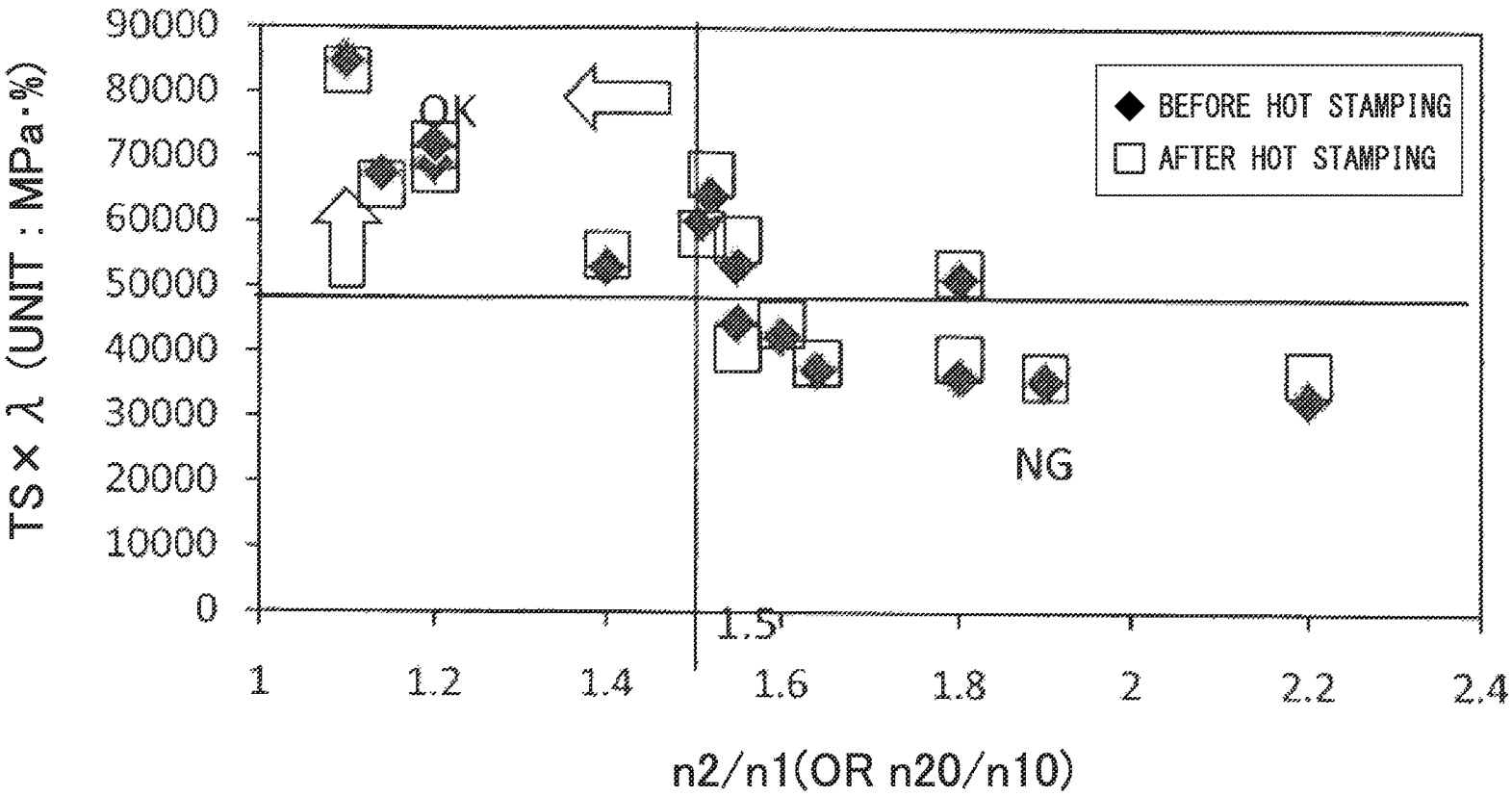
FIG. 3 is a graph showing the relationship between n20/n10 and TS×λ in the cold-rolled steel sheet for hot stamping before quenching in the hot stamping and the relationship between n2/n1 and TS×λ in the hot-stamped steel and showing the foundation of an expression (D).

In addition, in the cold-rolled steel sheet before quenching in the hot stamping and the hot-stamped steel, as a result of observing MnS at a location of ¼ of the sheet thickness and in the central portion of the sheet thickness, it was found that it is preferable that the area fraction of the MnS having an equivalent circle diameter of 0.1 μm to 10 μm is 0.01% or less, and, as shown in FIG. 3, the following expression (D) ((J) as well) is satisfied in order to favorably and stably satisfy the condition of TS×λ≥50000 MPa·%. When the MnS having an equivalent circle diameter of 0.1 μm or more exists during a hole expansibility test, since stress concentrates in the vicinity thereof, cracking is likely to occur. A reason for not counting the MnS having an equivalent circle diameter of less than 0.1 μm is that the effect on the stress concentration is small. In addition, a reason for not counting the MnS having an equivalent circle diameter of more than 10 μm is that, when the MnS having the above-described particle size is included in the hot-stamped steel or the cold-rolled steel sheet, the particle size is too large, and the hot-stamped steel or the cold-rolled steel sheet becomes unsuitable for working. Furthermore, when the area fraction of the MnS having an equivalent circle diameter of 0.1 μm to 10 μm exceeds 0.01%, since it becomes easy for fine cracks generated due to the stress concentration to propagate, the hole expansibility further deteriorates, and there is a case in which the condition of TS×λ≥50000 MPa·% is not satisfied. Here, "n1" and "n10" are number densities of the MnS having an equivalent circle diameter of 0.1 μm to 10 μm at the ¼ portion of the sheet thickness in the hot-stamped steel and the cold-rolled steel sheet before quenching in the hot stamping, respectively, and "n2" and "n20" are number densities of the MnS having an equivalent circle diameter of 0.1 μm to 10 μm at the central portion of the sheet thickness in the hot-stamped steel and the cold-rolled steel sheet before quenching in the hot stamping, respectively.

$$n2/n1<1.5 \quad \text{(D)}$$

$$n20/n0<1.5 \quad \text{(J)}$$

These relationships are all identical to the steel sheet before quenching in the hot stamping, the steel sheet after hot stamping, and the hot-stamped steel.

When the area fraction of the MnS having an equivalent circle diameter of 0.1 μm to 10 μm is more than 0.01% after hot stamping, the hole expansibility is likely to degrade. The lower limit of the area fraction of the MnS is not particularly specified, however, 0.0001% or more of the MnS is present due to a below-described measurement method, a limitation of a magnification and a visual field, and an original amount of Mn or the S. In addition, a value of an n2/n1 (or an n20/n10) of 1.5 or more indicates that a number density of the MnS having an equivalent circle diameter of 0.1 μm to 10 μm in the central portion of the sheet thickness of the hot-stamped steel (or the cold-rolled steel sheet before hot stamping) is 1.5 or more times the number density of the MnS having an equivalent circle diameter of 0.1 μm or more in the ¼ portion of the sheet thickness of the hot-stamped steel (or the cold-rolled steel sheet before hot stamping). In this case, the formability is likely to degrade due to a segregation of the MnS in the central portion of the sheet thickness of the hot-stamped steel (or the cold-rolled steel sheet before hot stamping). In the embodiment, the equivalent circle diameter and number density of the MnS having an equivalent circle diameter of 0.1 μm to 10 μm were measured with a field emission scanning electron microscope (Fe-SEM) manufactured by JEOL Ltd. At a measurement, a magnification was 1000 times, and a measurement area of the visual field was set to 0.12×0.09 $mm^2$ (=10800 $\mu m^2 \approx 10000\ \mu m^2$). Ten visual fields were observed in the ¼ portion of the sheet thickness, and ten visual fields were observed in the central portion of the sheet thickness. The area fraction of the MnS having an equivalent circle diameter of 0.1 μm to 10 μm was computed with particle analysis software. In the hot-stamped steel according to the embodiment, the form (shape and number) of the MnS formed before hot stamping is the same before and after hot stamping. FIG. 3 is a view showing a relationship between the n2/n1 and TS×λ after hot stamping and a relationship between an n20/n10 and TS×λ before quenching in the hot stamping, and, according to FIG. 3, the n20/n10 of the cold-rolled steel sheet before quenching in the hot stamping and the n2/n1 of the hot-stamped steel are almost the same. This is because the form of the MnS does not change at a typical heating temperature of hot stamping.

When the hot stamping is carried out on the cold-rolled steel sheet having the above-described configuration, it is possible to obtain a hot-stamped steel having a tensile strength of 400 MPa to 1000 MPa, and hole expansibility is significantly improved in the hot-stamped steel having a tensile strength of approximately 400 MPa to 800 MPa.

Furthermore, a hot-dip galvanized layer, a galvannealed layer, an electrogalvanized layer or an aluminized layer may be formed on a surface of the hot-stamped steel according to the embodiment. It is preferable to form the above-described plating in terms of rust prevention. A formation of the above-described platings does not impair the effects of the embodiment. The above-described platings can be carried out with a well-known method.

A cold-rolled steel sheet according to another embodiment of the present invention includes, by mass %, C: 0.030% to 0.150%; Si: 0.010% to 1.000%; Mn: 0.50% or more and less than 1.50%; P: 0.001% to 0.060%; S: 0.001% to 0.010%; N: 0.0005% to 0.0100%; Al: 0.010% to 0.050%, and optionally at least one of B: 0.0005% to 0.0020%; Mo: 0.01% to 0.50%; Cr: 0.01% to 0.50%; V: 0.001% to 0.100%; Ti: 0.001% to 0.100%; Nb: 0.001% to 0.050%; Ni: 0.01% to 1.00%; Cu: 0.01% to 1.00%; Ca: 0.0005% to 0.0050%; REM: 0.0005% to 0.0050%, and a balance of Fe and impurities, in which, when [C] is the amount of C by mass %, [Si] is the amount of Si by mass %, and [Mn] is the amount of Mn by mass %, the following expression (A) is satisfied, the area fraction of ferrite is 40% to 95% and the area fraction of martensite is 5% to 60%, the total of the area fraction of ferrite and the area fraction of martensite is 60% or more, the cold-rolled steel sheet optionally further can include one or more of pearlite, retained austenite, and bainite, the area fraction of pearlite is 10% or less, the volume fraction of retained austenite is 5% or less, and the area fraction of bainite is less than 40%, the hardness of the martensite measured with a nanoindenter satisfies the following expression (H) and the following expression (I), TS×λ which is a product of tensile strength TS and hole expansion ratio λ is 50000 MPa·% or more.

$$(5\times[Si]+[Mn])/[C]>10 \quad (A)$$

$$H20/H10<1.10 \quad (H)$$

$$\sigma HM0<20 \quad (I)$$

The H10 is the average hardness of the martensite in a surface portion of a sheet thickness, the H20 is the average hardness of the martensite in a central portion of the sheet thickness, the central portion is an area having a width of 200 μm in the thickness direction at a center of the sheet thickness, and the σHM0 is the variance of the average hardness of the martensite in the central portion of the sheet thickness.

The above hot-stamped steel is obtained by hot-stamping the cold-rolled steel sheet according to the embodiment as described below. Even when the cold-rolled steel sheet is hot stamped, the chemical composition of the cold-rolled steel sheet does not change. In addition, as described above, when the hardness ratio of the martensite between the surface portion of the sheet thickness, and the central portion of the sheet thickness and the hardness distribution of the martensite in the central portion of the sheet thickness are in the above predetermined state in a phase before quenching in the hot stamping, the state is almost maintained even after hot stamping (see also FIG. 2A and FIG. 2B). Furthermore, when the state of ferrite, martensite, pearlite, retained austenite, and bainite is in the above predetermined state in a phase before quenching in the hot stamping, the state is almost maintained even after hot stamping. Accordingly, the features of the cold-rolled steel sheet according to the embodiment are substantially the same as the features of the above hot-stamped steel.

In the cold-rolled steel sheet according to the embodiment, the area fraction of MnS existing in the cold-rolled steel sheet and having an equivalent circle diameter of 0.1 μm to 10 μm may be 0.01% or less, and the following expression (J) may be satisfied $$n20/n10<1.5 \quad (J)$$

The n10 is the average number density per 10000 $\mu m^2$ of the MnS having an equivalent circle diameter of 0.1 μm to 10 μm in a ¼ portion of the sheet thickness, and the n20 is the average number density per 10000 $\mu m^2$ of the MnS having an equivalent circle diameter of 0.1 μm to 10 μm in the central portion of the sheet thickness.

As described above, the ratio of n20 to n10 having the cold-rolled steel sheet before hot stamping is almost maintained even after hot-stamping the cold-rolled steel sheet (see also FIG. 3). In addition, the area fraction of MnS is almost the same before and after hot stamping. Accordingly, features having the cold-rolled steel sheet according to the embodiment are substantially the same as features having the above hot-stamped steel.

A hot-dip galvanized layer may be formed on a surface of the cold-rolled steel sheet according to the embodiment in a similar manner with the above-described hot-stamped steel. In addition, the hot-dip galvanized layer may be alloyed in the cold-rolled steel sheet according to the embodiment. Furthermore, an electrogalvanized layer or aluminized layer may be formed on the surface of the cold-rolled steel sheet according to the embodiment.

Hereinafter, a method for producing the cold-rolled steel sheet (a cold-rolled steel sheet, a galvanized cold-rolled steel sheet, a galvannealed cold-rolled steel sheet, an electrogalvanized cold-rolled steel sheet and an aluminized cold-rolled steel sheet) and a method for producing the hot-stamped steel for which the cold-rolled steel sheet is used according to the embodiments will be described.

When producing the cold-rolled steel sheet and the hot-stamped steel for which the cold-rolled steel sheet is used according to the embodiments, as an ordinary condition, a molten steel from a converter is continuously cast, thereby producing a steel. In the continuous casting, when a casting rate is fast, precipitates of Ti and the like become too fine, and, when the casting rate is slow, productivity deteriorates, and consequently, the above-described precipitates coarsen and the number of grains (for example, ferrite, martensite and the like) in the microstructure decreases, the grains coarsen in the microstructure, and thus, there is a case other characteristics such as a delayed fracture cannot be controlled. Therefore, the casting rate is desirably 1.0 m/minute to 2.5 m/minute.

The steel after the casting can be subjected to hot-rolling as it is. Alternatively, in a case in which the steel after cooling has been cooled to less than 1100° C., it is possible to reheat the steel after cooling to 1100° C. to 1300° C. in a tunnel furnace or the like and subject the steel to hot-rolling. When the heating temperature is less than 1100° C., it is difficult to ensure a finishing temperature in the hot-rolling, which causes a degradation of the elongation. In addition, in the hot-stamped steel for which a cold-rolled steel sheet to which Ti and Nb are added is used, since the dissolution of the precipitates becomes insufficient during the heating, which causes a decrease in strength. On the other hand, when the heating temperature is more than 1300° C., the amount of scale formed increases, and there is a case in which it is not possible to make surface property of the hot-stamped steel favorable.

Figure 6:
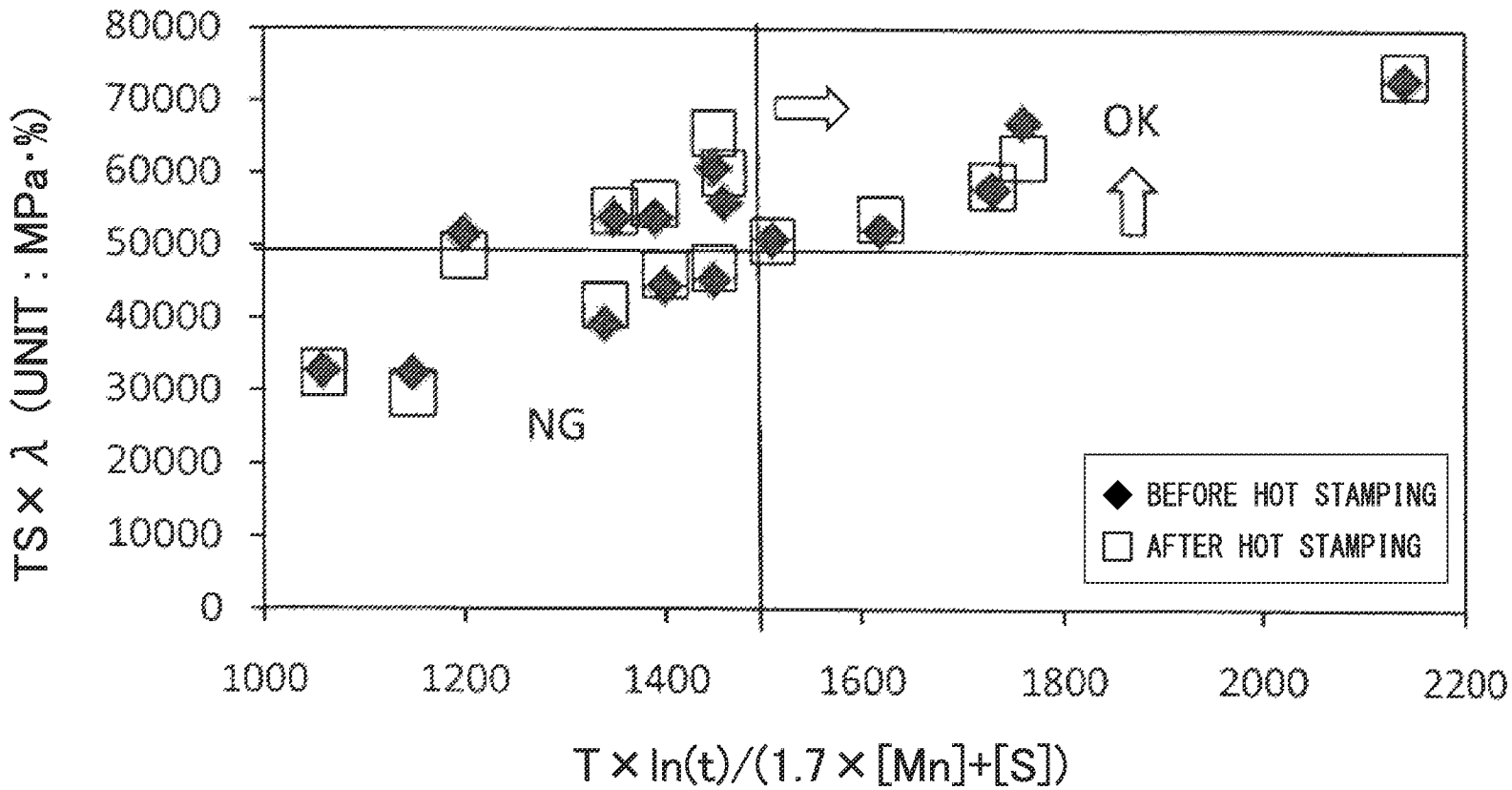
FIG. 6 is a graph showing the relationship between T×ln(t)/(1.7×[Mn]+[S]) and TS×λ, and showing the foundation of an expression (G).

In addition, to decrease the area fraction of the MnS having an equivalent circle diameter of 0.1 μm to 10 μm, when the amount of Mn and the amount of S in the steel are respectively represented by [Mn] and [S] by mass %, it is preferable for a temperature T (° C.) of a heating furnace before carrying out hot-rolling, an in-furnace time t (minutes), [Mn] and [S] to satisfy a following expression (G) as shown in FIG. 6.

$$T\times\ln(t)/(1.7\times[\mathrm{Mn}]+[\mathrm{S}])>1500 \quad (G)$$

When T×ln(t)/(1.7×[Mn]+[S]) is equal to or less than 1500, the area fraction of the MnS having an equivalent circle diameter of 0.1 μm to 10 μm becomes large, and there is a case in which a difference between the number density of the MnS having an equivalent circle diameter of 0.1 μm to 10 μm in the ¼ portion of the sheet thickness and the number density of the MnS having an equivalent circle diameter of 0.1 μm to 10 μm in the central portion of the sheet thickness becomes large. The temperature of the heating furnace before carrying out hot-rolling refers to an extraction temperature at an outlet side of the heating furnace, and the in-furnace time refers to a time elapsed from a placement of the steel into the hot heating furnace to an extraction of the steel from the heating furnace. Since the MnS does not change even after hot stamping as described above, it is preferable to satisfy the expression (G) in a heating step before hot-rolling.

Next, the hot-rolling is carried out according to a conventional method. At this time, it is desirable to carry out hot-rolling on the steel at the finishing temperature (the hot-rolling end temperature) which is set to be in a range of an $Ar_3$ temperature to 970° C. When the finishing temperature is less than the $Ar_3$ temperature, the hot-rolling includes a (α+γ) two-phase region rolling (two-phase region rolling of the ferrite+the martensite), and there is a concern that the elongation may degrade. On the other hand, when the finishing temperature exceeds 970° C., the austenite grain size coarsens, and the fraction of the ferrite becomes small, and thus, there is a concern that the elongation may degrade. A hot-rolling facility may have a plurality of stands.

Here, the $Ar_3$ temperature was estimated from an inflection point of a length of a test specimen after carrying out a formastor test.

After the hot-rolling, the steel is cooled at an average cooling rate of 20° C./second to 500° C./second, and is coiled at a predetermined coiling temperature CT. In a case in which the average cooling rate is less than 20° C./second, the pearlite that causes the degradation of the ductility is likely to be formed. On the other hand, the upper limit of the cooling rate is not particularly specified and is set to approximately 500° C./second in consideration of a facility specification, but is not limited thereto.

Figure 4:
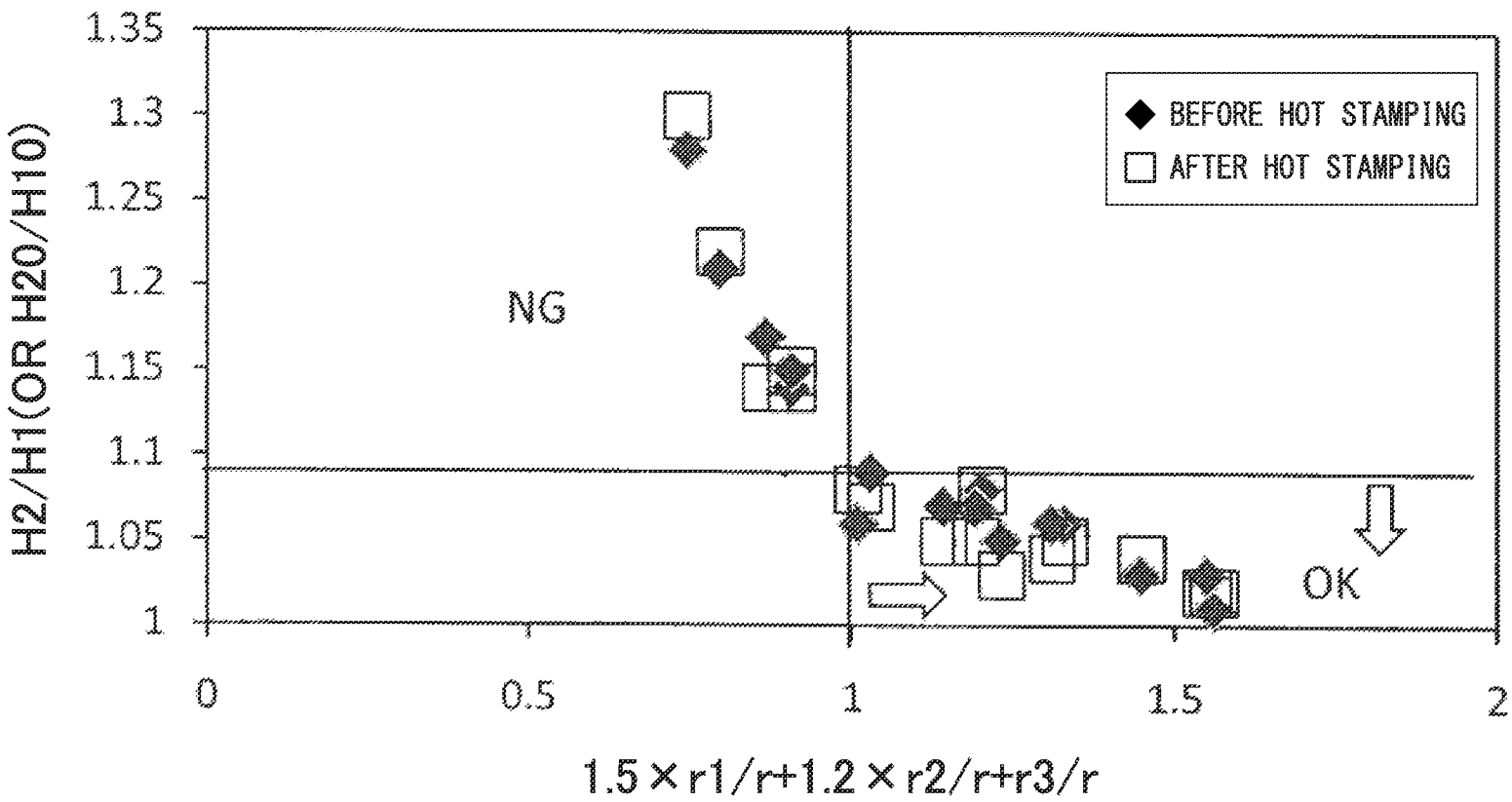
FIG. 4 is a graph showing the relationship between 1.5×r1/r+1.2×r2/r+r3/r and H20/H10 in the cold-rolled steel sheet for hot stamping before quenching in the hot stamping and the relationship between 1.5×r1/r+1.2×r2/r+r3/r and H2/H1 in the hot-stamped steel, and showing the foundation of an expression (E).

After coiling the steel, pickling is carried out, and cold-rolling is carried out. At this time, to obtain a range satisfying the above-described expression (C) as shown in FIG. 4, the cold-rolling is carried out under a condition in which the following expression (E) is satisfied. When conditions for annealing, cooling and the like described below are further satisfied after the above-described rolling, TS×λ≥50000 MPa·% is ensured in the cold-rolled steel sheet before hot stamping and/or the hot-stamped steel. From the viewpoint of the productivity, the cold-rolling is desirably carried out with a tandem rolling mill in which a plurality of rolling mills are linearly disposed, and the steel sheet is continuously rolled in a single direction, thereby obtaining a predetermined thickness.

$$1.5\times r1/r+1.2\times r2/r+r3/r>1.00 \quad (E)$$

Here, the "ri" is an individual target cold-rolling reduction (%) at an ith stand (i=1, 2, 3) from an uppermost stand in the cold-rolling, and the "r" is a total target cold-rolling reduction (%) in the cold-rolling. The total cold-rolling reduction is a so-called cumulative reduction, and on a basis of the sheet thickness at an inlet of a first stand, is a percentage of the cumulative reduction (the difference between the sheet thickness at the inlet before a first pass and the sheet thickness at an outlet after a final pass) with respect to the above-described basis.

When the steel is cold-rolled under the conditions in which the expression (E) is satisfied, it is possible to sufficiently divide pearlite in the cold-rolling even when a large pearlite exists before the cold-rolling. As a result, it is possible to eliminate pearlite or limit the area fraction of pearlite to a minimum through the annealing carried out after cold-rolling, and therefore it becomes easy to obtain a structure in which the expression (B) and the expression (C) (or the expression (H) and the expression (I)) are satisfied. On the other hand, in a case in which the expression (E) is not satisfied, the cold-rolling reductions in upper stream stands are not sufficient, the large pearlite is likely to remain, and it is not possible to form a desired martensite in the following annealing. Therefore, it is not possible to obtain a structure in which the expression (B) and the expression (C) (or the expression (H) and the expression (I)) are satisfied. That is, in the case in which the expression (E) is not satisfied, it is not possible to obtain a feature of H2/H1<1.10 (or H20/H10<1.10), and a feature of σHM<20 (or σHM0<20). In addition, the inventors found that, when the expression (E) is satisfied, an obtained form of the martensite structure after the annealing is maintained in almost the same state even after hot stamping is carried out, and therefore the hot-stamped steel according to the embodiment becomes advantageous in terms of the elongation or the hole expansibility even after hot stamping. In a case in which the hot-stamped steel according to the embodiment is heated up to the two-phase region in the hot stamping, a hard phase including martensite before quenching in the hot stamping turns into an austenite structure, and ferrite before quenching in the hot stamping remains as it is. Carbon (C) in austenite does not move to the peripheral ferrite. After that, when cooled, austenite turns into a hard phase including martensite. That is, when the expression (E) is satisfied, the expression (H) is satisfied before hot stamping and the expression (B) is satisfied after hot stamping, and thereby the hot-stamped steel becomes excellent in terms of the formability.

r, r1, r2 and r3 are the target cold-rolling reductions. Generally, the cold-rolling is carried out while controlling the target cold-rolling reduction and an actual cold-rolling reduction to become substantially the same value. It is not preferable to carry out the cold-rolling in a state in which the actual cold-rolling reduction is unnecessarily made to be different from the target cold-rolling reduction. However, in a case in which there is a large difference between a target rolling reduction and an actual rolling reduction, it is possible to consider that the embodiment is carried out when the actual cold-rolling reductions satisfy the expression (E). Furthermore, the actual cold-rolling reduction is preferably within ±10% of the target cold-rolling reduction.

In addition, it is more preferable that the actual cold-rolling reductions satisfy the following expression.

$$1.20 \geq 1.5 \times r1/r + 1.2 \times r2/r + r3/r > 1.00 \quad \text{(E')}$$

When "1.5×r1/r+1.2×r2/r+r3/r" exceeds 1.20, a heavy load is applied to a cold rolling mill, productivity is degraded. Tensile strength of the steel sheet according to the above-described embodiment is a range of 400 MPa to 1000 MPa, and is much larger than the tensile strength of typical cold-rolled steel sheets. It is necessary to apply a rolling load of 1800 ton or more per a stand in order to carry out the cold-rolling under a condition that "1.5×r1/r+1.2×r2/r+r3/r" exceeds 1.20 in the steel sheet having such tensile strength. It is difficult to apply such heavy rolling load in consideration of rigidity of stands and/or rolling facility capability. Furthermore, when such heavy rolling load is applied, there is a concern that production efficiency is degraded.

After cold-rolling, a recrystallization is caused in the steel sheet by annealing the steel. The annealing forms a desired martensite. Furthermore, regarding an annealing temperature, it is preferable to carry out the annealing by heating the steel sheet to 700° C. to 850° C., and cool the steel sheet to a room temperature or a temperature at which a surface treatment such as the galvanizing is carried out. When the annealing is carried out in the above-described range, it is possible to stably ensure a predetermined area fraction of the ferrite and a predetermined area fraction of the martensite, to stably set the total of the area fraction of the ferrite and the area fraction of the martensite to 60% or more, and to contribute to an improvement of TS×λ. A holding time at 700° C. to 850° C. is preferably 1 second or more as long as the productivity is not impaired (for example, 300 second) to reliably obtain a predetermined structure. The temperature-increase rate is preferable in a range of 1° C./second to an upper limit of a facility capacity, and the cooling rate is preferable in a range of 1° C./second to the upper limit of the facility capacity. In a temper-rolling step, temper-rolling is carried out with a conventional method. The elongation ratio of the temper-rolling is, generally, approximately 0.2% to 5%, and is preferable within a range in which a yield point elongation is avoided and the shape of the steel sheet can be corrected.

As a still more preferable condition of the embodiment, when the amount of C (mass %), the amount of Mn (mass %), the amount of Cr (mass %) and the amount of Mo (mass %) of the steel are represented by [C], [Mn], [Cr] and [Mo], respectively, regarding the coiling temperature CT, it is preferable to satisfy the following expression (F).

$$560-474\times[C]-90\times[Mn]-20\times[Cr]-20\times[Mo]<CT<830-270\times[C]-90\times[Mn]-70\times[Cr]-80\times[Mo] \quad \text{(F)}$$

Figure 5A:
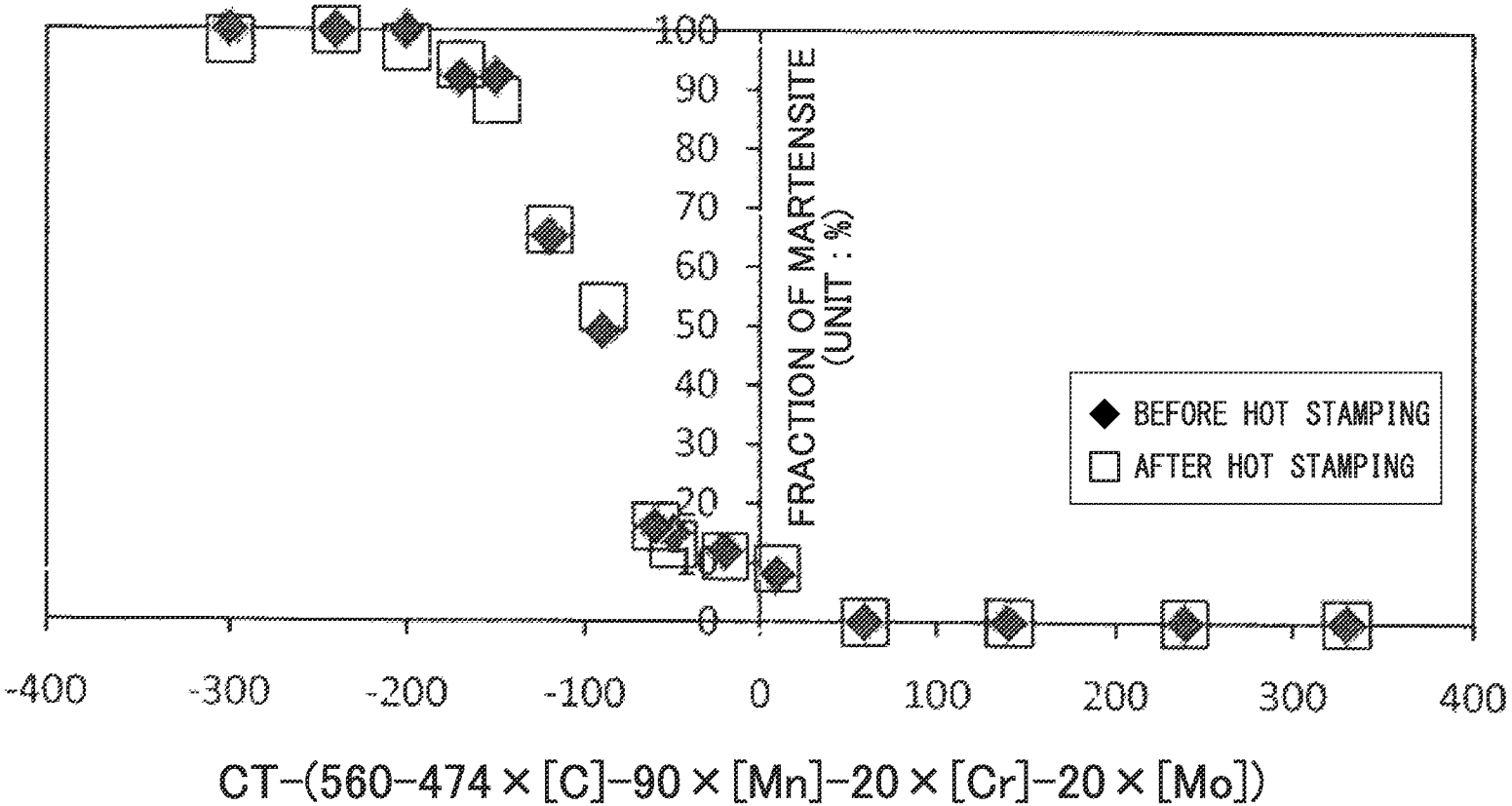
FIG. 5A is a graph showing the relationship between an expression (F) and a fraction of a martensite.
Figure 5B:
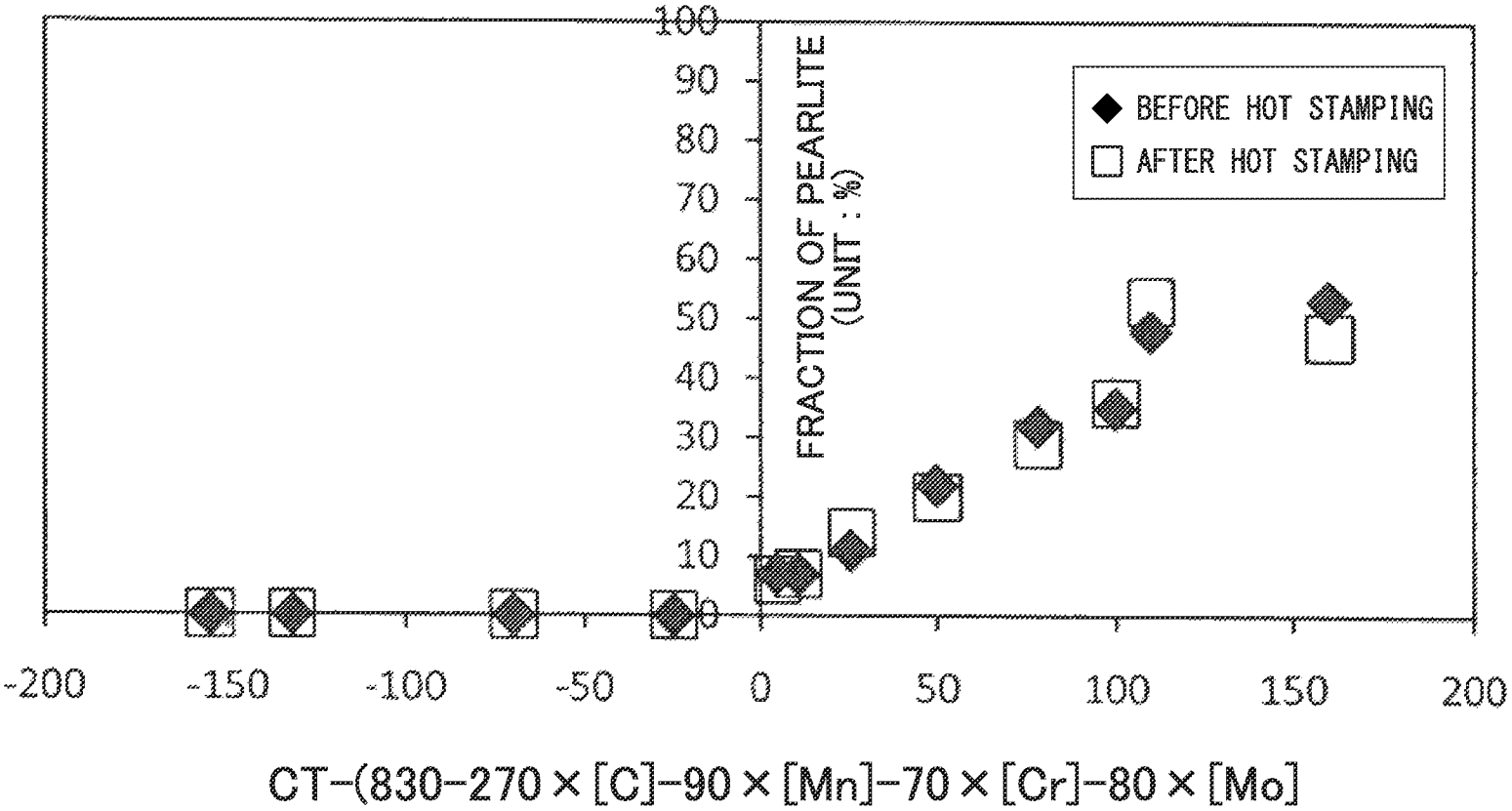
FIG. 5B is a graph showing the relationship between the expression (F) and a fraction of a pearlite.

As shown in FIG. 5A, when the coiling temperature CT is less than "560−474×[C]−90×[Mn]−20×[Cr]−20×[Mo]", the martensite is excessively formed, the steel sheet becomes too hard, and there is a case in which the following cold-rolling becomes difficult. On the other hand, as shown in FIG. 5B, when the coiling temperature CT exceeds "830−270×[C]−90×[Mn]−70×[Cr]−80×[Mo]", a banded structure of the ferrite and the pearlite is likely to be formed, and furthermore, a fraction of the pearlite in the central portion of the sheet thickness is likely to increase. Therefore, the uniformity of a distribution of the martensite formed in the following annealing degrades, and it becomes difficult to satisfy the above-described expression (C). In addition, there is a case in which it becomes difficult for the martensite to be formed in a sufficient amount.

When the expression (F) is satisfied, the ferrite and the hard phase have an ideal distribution form before hot stamping as described above. In this case, when a two-phase region heating is carried out in the hot stamping, the distribution form is maintained as described above. If it is possible to more reliably ensure a microstructure having the above-described feature by satisfying the expression (F), the microstructure is maintained even after hot stamping, and the hot-stamped steel becomes excellent in terms of formability.

Furthermore, to improve the rust-preventing capability, it is also preferable to include a galvanizing step in which a galvanized layer is formed on the steel between an annealing step and the temper-rolling step, and to form the galvanized layer on a surface of the cold-rolled steel sheet. Furthermore, it is also preferable that the method for producing according to the embodiment include an alloying step in which an alloying treatment is performed after galvanizing the steel. In a case in which the alloying treatment is performed, a treatment in which a galvannealed surface is brought into contact with a substance oxidizing the galvannealed surface such as water vapor, thereby thickening of an oxidized film may be further carried out on the surface.

It is also preferable to include, for example, an electrogalvanizing step in which an electrogalvanized layer is formed on the steel after the temper-rolling step as well as the galvanizing step and the galvannealing step and to form an electrogalvanized layer on the surface of the cold-rolled steel sheet. In addition, it is also preferable to include, instead of the galvanizing step, an aluminizing step in which an aluminized layer is formed on the steel between the annealing step and the temper-rolling step. The aluminizing is generally hot-dip aluminizing which is preferable.

After a series of the above-described treatments, the steel is heated to a temperature range of 700° C. to 1000° C., and is hot stamped in the temperature range. In the hot stamping step, the hot stamping is desirably carried out, for example, under the following conditions. First, the steel sheet is heated up to 700° C. to 1000° C. at the temperature-increase rate of 5° C./second to 500° C./second, and the hot stamping (a hot stamping step) is carried out after the holding time of 1 second to 120 seconds. To improve the formability, the heating temperature is preferably an $Ac_3$ temperature or less. Subsequently, the steel sheet is cooled, for example, to the room temperature to 300° C. at the cooling rate of 10° C./second to 1000° C./second (quenching in the hot stamping). The $Ac_3$ temperature was calculated from the inflection point of the length of the test specimen after carrying out the formastor test and measuring the infection point.

When the heating temperature in the hot stamping step is less than 700° C., the quenching is not sufficient, and consequently, the strength cannot be ensured, which is not preferable. When the heating temperature is more than 1000° C., the steel sheet becomes too soft, and, in a case in which a plating, particularly zinc plating, is formed on the surface of the steel sheet, there is a concern that the zinc may be evaporated and burned, which is not preferable. Therefore, the heating temperature in the hot stamping is preferably 700° C. to 1000° C. When the temperature-increase rate is less than 5° C./second, since it is difficult to control heating in the hot stamping, and the productivity significantly degrades, it is preferable to carry out the heating at the temperature-increase rate of 5° C./second or more. On the other hand, the upper limit of the temperature-increase rate of 500° C./second depends on a current heating capability, but is not necessary to limit thereto. At a cooling rate of less than 10° C./second, since the rate control of the cooling after the hot stamping step is difficult, and the productivity also significantly degrades, it is preferable to carry out the cooling at the cooling rate of 10° C./second or more. The upper limit of the cooling rate of 1000° C./second depends on a current cooling capability, but is not necessary to limit thereto. A reason for setting a time until the hot stamping after an increase in the temperature to 1 second or more is a current process control capability (a lower limit of a facility capability), and a reason for setting the time until the hot stamping after the increase in the temperature to 120 seconds or less is to avoid an evaporation of the zinc or the like in a case in which the galvanized layer or the like is formed on the surface of the steel sheet. The reason for setting the cooling temperature to the room temperature to 300° C. is to sufficiently ensure the martensite and ensure the strength of the hot-stamped steel.

Figure 8:
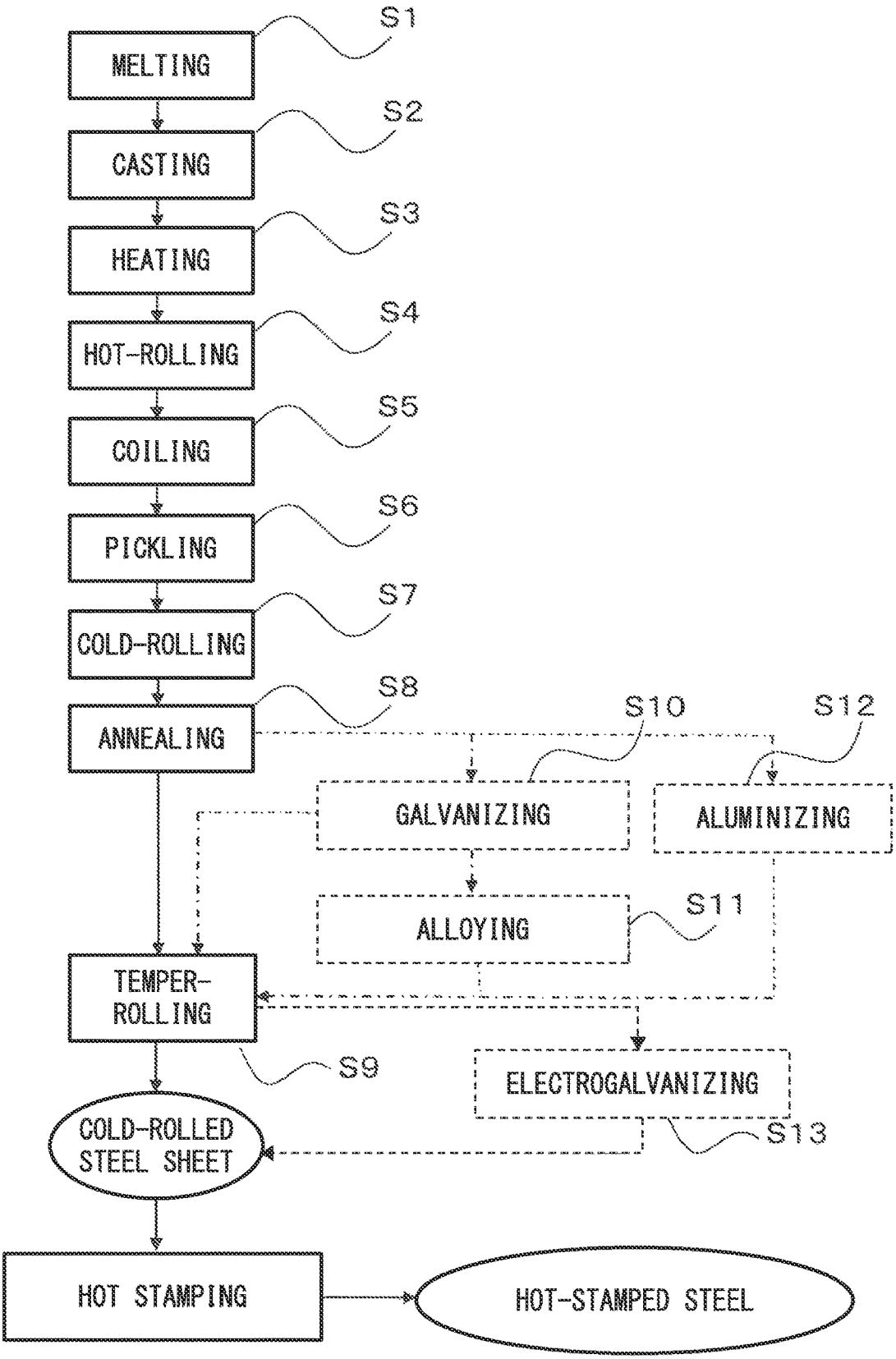
FIG. 8 is a flowchart showing a method for producing the hot-stamped steel for which a cold-rolled steel sheet for hot stamping is used according to an embodiment of the present invention.

FIG. 8 is a flowchart showing the method for producing the hot-stamped steel according to the embodiment of the present invention. Each of reference signs S1 to S13 in the drawing corresponds to individual step described above.

In the hot-stamped steel of the embodiment, the expression (B) and the expression (C) are satisfied even after hot stamping is carried out under the above-described condition. In addition, consequently, it is possible to satisfy the condition of $TS \times \lambda \geq 50000$ MPa·% even after hot stamping is carried out.

As described above, when the above-described conditions are satisfied, it is possible to manufacture the hot-stamped steel in which the hardness distribution or the structure is maintained even after hot stamping, and consequently the strength is ensured and a more favorable hole expansibility can be obtained.

EXAMPLES

Steel having a composition described in Table 1-1 and Table 1-2 was continuously cast at a casting rate of 1.0 m/minute to 2.5 m/minute, a slab was heated in a heating furnace under a conditions shown in Table 5-1 and Table 5-2 with a conventional method as it is or after cooling the slab once, and hot-rolling was carried out at a finishing temperature of 910° C. to 930° C., thereby producing a hot rolled steel sheet. After that, the hot rolled steel sheet was coiled at a coiling temperature CT described in Table 5-1 and Table 5-2. After that, pickling was carried out so as to remove a scale on a surface of the steel sheet, and a sheet thickness was made to be 1.2 mm to 1.4 mm through cold-rolling. At this time, the cold-rolling was carried out so that the value of the expression (E) became a value described in Table 5-1 and Table 5-2.

Figure 7:
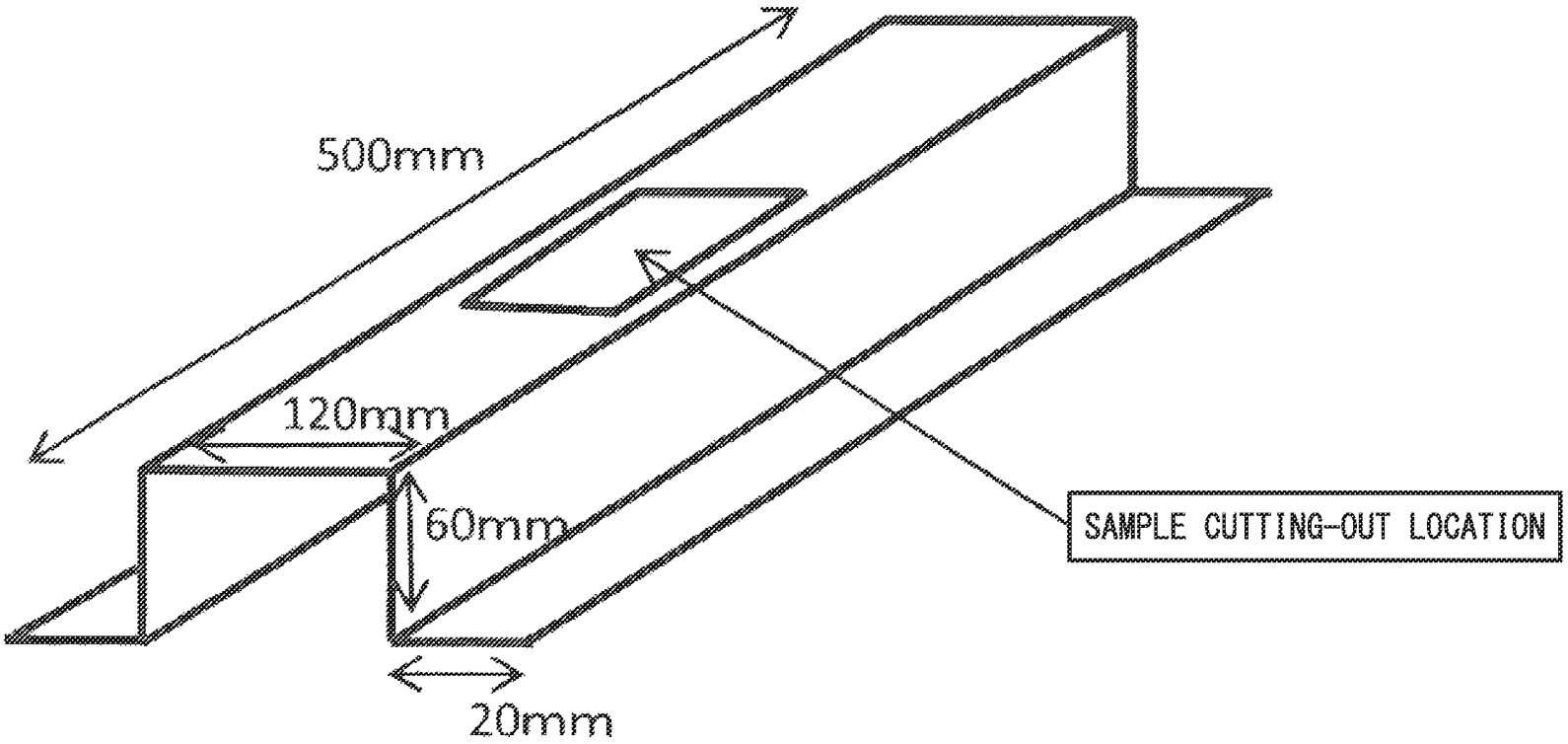
FIG. 7 is a perspective view of a hot-stamped steel used in an example.

After cold-rolling, annealing was carried out in a continuous annealing furnace at an annealing temperature described in Table 2-1 and Table 2-2. On a part of the steel sheets, a galvanized layer was further formed in the middle of cooling after a soaking in the continuous annealing furnace, and then an alloying treatment was further performed on a part of the part of the steel sheets, thereby forming a galvannealed layer. In addition, an electrogalvanized layer or an aluminized layer was formed on another part of the steel sheets. Furthermore, temper-rolling was carried out at an elongation ratio of 1% according to a conventional method. In this state, a sample was taken to evaluate material qualities and the like before quenching in the hot stamping, and a material quality test or the like was carried out. After that, to obtain a hot-stamped steel having a form as shown in FIG. 7, hot stamping was carried out. In the hot stamping, a temperature was increased at a temperature-increase rate of 10° C./second to 100° C./second, the steel sheet was held at a heating temperature of 800° C. for 10 seconds, and was cooled at a cooling rate of 100° C./second to 200° C. or less. A sample was cut from a location of FIG. 7 in an obtained hot-stamped steel, the material quality test and the like were carried out, and the tensile strength (TS), the elongation (El), the hole expansion ratio (Q) and the like were obtained. The results are described in Table 2-1 to Table 5-2. The hole expansion ratios λ in the tables were obtained from the following expression (L).

$$\lambda(\%)=\{(d'-d)/d\}\times 100 \quad \text{(L)}$$

d': a hole diameter when a crack penetrates the sheet thickness d: an initial hole diameter Furthermore, regarding plating types in Table 3-1 and Table 3-2, CR represents a non-plated cold-rolled steel sheet, GI represents that the galvanized layer is formed, GA represents that the galvannealed layer is formed, EG represents that the electrogalvanized layer is formed, and Al represents that the aluminized layer is formed.

Furthermore, determinations G and B in the tables have the following meanings.

G: a target condition expression is satisfied.

B: the target condition expression is not satisfied.

The chemical conversion treatment property after hot stamping was evaluated as a surface property after hot stamping in a hot-stamped steel produced from a non-plated cold-rolled steel sheet. The plating adhesion of hot-stamped steel was evaluated as a surface property after hot stamping when zinc, aluminum, or the like was plated on a cold-rolled steel sheet from which a hot-stamped steel was produced.

The chemical conversion treatment property was evaluated through the following procedure. First, a chemical conversion treatment was applied to each sample under a condition that the bath temperature was 43° C. and the time period for chemical conversion treatment was 120 seconds using a commercial chemical conversion treatment agent (Palbond PB-L3020 system manufactured by Nihon Parkerizing Co. Ltd.). Second, the crystal uniformity of a conversion coating was evaluated by SEM observation on the surface of each sample to which the chemical conversion treatment is applied. The crystal uniformity of a conversion coating was classified by the following valuation standards. Good (G) was given to a sample without lack of hiding in crystals of the conversion coating, bad (B) was given to a sample with a lack of hiding in an area of crystals of the conversion coating, and very bad (VB) was given to a sample with a conspicuous lack of hiding in crystals of the conversion coating.

The plating adhesion was evaluated through the following procedure. First, a sheet specimen for testing having a height of 100 mm, a width of 200 mm, and a thickness of 2 mm was taken from a plated cold-rolled steel sheet. The plating adhesion was evaluated by applying a V bending and straightening test to the sheet specimen. In the V bending and straightening test, the above sheet specimen was bent using a die for the V bending test (a bending angle of 60°), and then the sheet specimen after the V bending was straightened again by a press working. A cellophane tape ("CELLOTAPE™ CT405AP-24" manufactured by Nichiban Co. Ltd.) was stuck on a portion (deformed portion) which was located in the inside of a bent portion during V bending in the straightened sheet specimen, and then the cellophane tape was taken off by hand. Next, the width of a detached plating layer which is stuck on the cellophane tape was measured. In the Examples, good (G) was given to a sheet specimen in which the width was 5 mm or less, bad (B) was given to a sheet specimen in which the width was more than 5 mm and 10 mm or less, and very bad (VB) was given to a sheet specimen in which the width was more than 10 mm.

TABLE 1-1

| STEEL TYPE REFERENCE SYMBOL | | C | Si | Mn | P | S | N | Al | Cr | Mo |
|---|---|---|---|---|---|---|---|---|---|---|
| A | EXAMPLE | 0.045 | 0.143 | 0.55 | 0.002 | 0.007 | 0.0033 | 0.031 | 0 | 0 |
| B | " | 0.061 | 0.224 | 0.63 | 0.025 | 0.005 | 0.0054 | 0.025 | 0 | 0 |
| C | " | 0.149 | 0.970 | 1.45 | 0.006 | 0.009 | 0.0055 | 0.035 | 0.22 | 0 |
| D | " | 0.075 | 0.520 | 0.69 | 0.007 | 0.006 | 0.0025 | 0.020 | 0 | 0.25 |
| E | " | 0.082 | 0.072 | 0.51 | 0.006 | 0.009 | 0.0032 | 0.045 | 0.40 | 0 |
| F | " | 0.098 | 0.212 | 1.15 | 0.007 | 0.009 | 0.0075 | 0.035 | 0 | 0 |
| G | " | 0.102 | 0.372 | 0.82 | 0.013 | 0.008 | 0.0035 | 0.037 | 0 | 0 |
| H | " | 0.085 | 0.473 | 0.53 | 0.056 | 0.001 | 0.0029 | 0.041 | 0.39 | 0.15 |
| I | " | 0.095 | 0.720 | 0.72 | 0.008 | 0.002 | 0.0055 | 0.032 | 0 | 0 |
| J | " | 0.071 | 0.777 | 0.82 | 0.006 | 0.008 | 0.0014 | 0.015 | 0 | 0.45 |
| K | " | 0.091 | 0.165 | 1.21 | 0.006 | 0.009 | 0.0035 | 0.041 | 0 | 0 |
| L | " | 0.102 | 0.632 | 1.11 | 0.015 | 0.007 | 0.0041 | 0.032 | 0 | 0.37 |
| M | " | 0.105 | 0.301 | 1.22 | 0.012 | 0.009 | 0.0015 | 0.035 | 0 | 0 |
| N | " | 0.105 | 0.253 | 1.44 | 0.008 | 0.005 | 0.0032 | 0.042 | 0 | 0.35 |
| O | " | 0.144 | 0.945 | 0.89 | 0.008 | 0.006 | 0.0043 | 0.036 | 0 | 0.21 |
| P | " | 0.095 | 0.243 | 1.45 | 0.009 | 0.007 | 0.0025 | 0.039 | 0.49 | 0 |
| Q | " | 0.115 | 0.342 | 1.03 | 0.015 | 0.004 | 0.0038 | 0.037 | 0 | 0.15 |
| R | " | 0.121 | 0.175 | 0.78 | 0.008 | 0.003 | 0.0038 | 0.036 | 0 | 0 |
| S | " | 0.129 | 0.571 | 0.93 | 0.016 | 0.006 | 0.0024 | 0.039 | 0 | 0.19 |
| T | " | 0.141 | 0.150 | 1.40 | 0.018 | 0.003 | 0.0029 | 0.031 | 0 | 0.21 |
| U | " | 0.129 | 0.105 | 1.35 | 0.018 | 0.007 | 0.0064 | 0.019 | 0 | 0.29 |
| W | " | 0.143 | 0.652 | 1.17 | 0.012 | 0.006 | 0.0019 | 0.038 | 0 | 0 |
| X | " | 0.141 | 0.922 | 1.02 | 0.015 | 0.004 | 0.0066 | 0.026 | 0.25 | 0.16 |
| Y | " | 0.131 | 0.155 | 1.47 | 0.008 | 0.006 | 0.0065 | 0.043 | 0.37 | 0 |
| Z | " | 0.149 | 0.105 | 1.32 | 0.009 | 0.003 | 0.0061 | 0.031 | 0 | 0.25 |

| STEEL TYPE REFERENCE SYMBOL | V | Ti | Nb | Ni | Cu | Ca | B | REM | EXPRESSION (A) |
|---|---|---|---|---|---|---|---|---|---|
| A | 0 | 0 | 0 | 0 | 0 | 0 | 0 | 0 | 28.1 |
| B | 0 | 0 | 0 | 0.5 | 0 | 0 | 0 | 0 | 28.7 |
| C | 0 | 0 | 0 | 0 | 0 | 0 | 0 | 0 | 42.3 |
| D | 0 | 0 | 0 | 0 | 0 | 0 | 0 | 0 | 43.9 |
| E | 0 | 0 | 0 | 0 | 0 | 0 | 0 | 0 | 10.6 |
| F | 0 | 0 | 0 | 0 | 0.7 | 0.005 | 0 | 0 | 22.6 |
| G | 0 | 0 | 0 | 0 | 0 | 0 | 0 | 0 | 26.3 |
| H | 0 | 0 | 0 | 0 | 0 | 0.004 | 0 | 0 | 34.1 |
| I | 0.05 | 0 | 0 | 0 | 0 | 0 | 0 | 0 | 45.5 |
| J | 0 | 0 | 0 | 0 | 0 | 0 | 0 | 0 | 66.3 |
| K | 0 | 0 | 0 | 0 | 0 | 0 | 0 | 0 | 22.4 |
| L | 0 | 0.07 | 0 | 0 | 0 | 0 | 0 | 0 | 41.9 |
| M | 0 | 0 | 0 | 0 | 0 | 0 | 0 | 0 | 26.0 |
| N | 0 | 0 | 0 | 0 | 0 | 0 | 0.0019 | 0 | 25.8 |
| O | 0 | 0 | 0 | 0 | 0 | 0 | 0 | 0 | 39.0 |
| P | 0 | 0 | 0 | 0 | 0 | 0 | 0 | 0 | 28.1 |
| Q | 0 | 0 | 0.03 | 0 | 0 | 0 | 0.0011 | 0 | 23.8 |
| R | 0 | 0 | 0.03 | 0 | 0 | 0 | 0 | 0 | 13.7 |
| S | 0 | 0 | 0 | 0 | 0 | 0 | 0 | 0 | 29.3 |
| T | 0 | 0.03 | 0 | 0 | 0 | 0 | 0 | 0 | 15.2 |
| U | 0 | 0 | 0 | 0 | 0 | 0 | 0.0009 | 0 | 14.5 |
| W | 0 | 0 | 0 | 0 | 0 | 0.003 | 0 | 0 | 31.0 |
| X | 0 | 0.07 | 0 | 0 | 0 | 0 | 0.0015 | 0.0025 | 39.9 |
| Y | 0 | 0 | 0 | 0 | 0 | 0 | 0.0013 | 0 | 17.1 |
| Z | 0.04 | 0 | 0 | 0 | 0 | 0 | 0 | 0 | 12.4 |

TABLE 1-2

| STEEL TYPE REFERENCE SYMBOL | | C | Si | Mn | P | S | N | Al | Cr | Mo |
|---|---|---|---|---|---|---|---|---|---|---|
| AA | COMPARATIVE EXAMPLE | 0.079 | 0.205 | 0.89 | 0.012 | 0.006 | 0.0021 | 0.029 | 0 | 0 |
| AB | COMPARATIVE EXAMPLE | 0.092 | 0.219 | 0.96 | 0.010 | 0.004 | 0.0029 | 0.041 | 0 | 0 |
| AC | COMPARATIVE EXAMPLE | 0.105 | 0.103 | 1.22 | 0.008 | 0.002 | 0.0041 | 0.039 | 0 | 0 |
| AD | COMPARATIVE EXAMPLE | 0.076 | 0.355 | 0.98 | 0.013 | 0.005 | 0.0039 | 0.033 | 0 | 0 |
| AE | COMPARATIVE EXAMPLE | 0.142 | 0.246 | 0.69 | 0.009 | 0.003 | 0.0030 | 0.031 | 0 | 0 |
| AF | COMPARATIVE EXAMPLE | 0.129 | 0.363 | 1.28 | 0.007 | 0.003 | 0.0040 | 0.042 | 0 | 0 |
| AG | COMPARATIVE EXAMPLE | 0.118 | 0.563 | 1.13 | 0.008 | 0.004 | 0.0039 | 0.041 | 0 | 0 |
| AH | COMPARATIVE EXAMPLE | 0.027 | 0.323 | 1.49 | 0.006 | 0.002 | 0.0031 | 0.032 | 0 | 0 |
| AI | COMPARATIVE EXAMPLE | 0.231 | 0.602 | 1.39 | 0.004 | 0.005 | 0.0013 | 0.040 | 0 | 0 |
| AJ | COMPARATIVE EXAMPLE | 0.093 | 0.004 | 1.01 | 0.006 | 0.008 | 0.0039 | 0.036 | 0 | 0.23 |
| AK | COMPARATIVE EXAMPLE | 0.098 | 1.493 | 0.71 | 0.007 | 0.003 | 0.0041 | 0.036 | 0.38 | 0.33 |
| AL | COMPARATIVE EXAMPLE | 0.125 | 0.780 | 0.21 | 0.011 | 0.003 | 0.0035 | 0.032 | 0 | 0 |
| AM | COMPARATIVE EXAMPLE | 0.136 | 0.040 | 2.75 | 0.008 | 0.003 | 0.0044 | 0.039 | 0 | 0 |
| AN | COMPARATIVE EXAMPLE | 0.103 | 0.265 | 1.12 | 0.095 | 0.004 | 0.0025 | 0.042 | 0.36 | 0.12 |
| AO | COMPARATIVE EXAMPLE | 0.072 | 0.223 | 1.41 | 0.002 | 0.025 | 0.0052 | 0.036 | 0 | 0 |
| AP | COMPARATIVE EXAMPLE | 0.051 | 0.281 | 1.03 | 0.012 | 0.007 | 0.1630 | 0.032 | 0 | 0 |
| AQ | COMPARATIVE EXAMPLE | 0.141 | 0.011 | 1.39 | 0.019 | 0.008 | 0.0045 | 0.003 | 0 | 0.23 |
| AR | COMPARATIVE EXAMPLE | 0.149 | 0.150 | 1.23 | 0.005 | 0.003 | 0.0035 | 0.065 | 0 | 0.37 |
| AS | COMPARATIVE EXAMPLE | 0.133 | 0.030 | 1.10 | 0.012 | 0.004 | 0.0020 | 0.035 | 0 | 0 |
| AT | COMPARATIVE EXAMPLE | 0.135 | 0.170 | 1.24 | 0.010 | 0.004 | 0.0023 | 0.035 | 0 | 0 |
| AU | COMPARATIVE EXAMPLE | 0.139 | 0.331 | 1.43 | 0.013 | 0.002 | 0.0044 | 0.030 | 0 | 0 |
| AV | COMPARATIVE EXAMPLE | 0.137 | 0.192 | 1.50 | 0.011 | 0.002 | 0.0041 | 0.033 | 0 | 0 |
| AW | COMPARATIVE EXAMPLE | 0.136 | 0.040 | 2.75 | 0.008 | 0.003 | 0.0044 | 0.039 | 0 | 0 |
| AX | COMPARATIVE EXAMPLE | 0.137 | 0.192 | 1.50 | 0.011 | 0.002 | 0.0041 | 0.033 | 0 | 0 |

| STEEL TYPE REFERENCE SYMBOL | V | Ti | Nb | Ni | Cu | Ca | B | REM | EXPRESSION (A) |
|---|---|---|---|---|---|---|---|---|---|
| AA | 0 | 0 | 0 | 0 | 0 | 0 | 0 | 0 | 24.2 |
| AB | 0 | 0 | 0 | 0 | 0 | 0 | 0 | 0 | 22.3 |
| AC | 0 | 0 | 0 | 0 | 0 | 0 | 0 | 0 | 16.5 |
| AD | 0 | 0 | 0 | 0 | 0 | 0 | 0 | 0 | 36.3 |
| AE | 0 | 0 | 0 | 0 | 0 | 0 | 0 | 0 | 13.5 |
| AF | 0 | 0 | 0 | 0 | 0 | 0 | 0 | 0 | 24.0 |
| AG | 0 | 0 | 0 | 0 | 0 | 0 | 0 | 0 | 33.4 |
| AH | 0 | 0 | 0 | 0 | 0 | 0 | 0 | 0.0050 | 115.0 |
| AI | 0 | 0 | 0 | 0 | 0 | 0 | 0 | 0 | 19.0 |
| AJ | 0 | 0 | 0 | 0 | 0 | 0 | 0.0011 | 0 | 11.1 |
| AK | 0 | 0 | 0 | 0 | 0 | 0 | 0.0013 | 0 | 83.4 |
| AL | 0 | 0 | 0 | 0 | 0 | 0 | 0 | 0 | 32.6 |
| AM | 0 | 0 | 0 | 0 | 0 | 0 | 0 | 0 | 21.7 |
| AN | 0 | 0 | 0.03 | 0 | 0 | 0 | 0 | 0 | 23.7 |
| AO | 0 | 0 | 0 | 0.4 | 0 | 0 | 0 | 0 | 35.1 |
| AP | 0 | 0 | 0.04 | 0 | 0 | 0.003 | 0 | 0 | 47.7 |
| AQ | 0 | 0 | 0 | 0 | 0 | 0 | 0 | 0 | 10.2 |
| AR | 0 | 0 | 0 | 0 | 0 | 0 | 0 | 0 | 13.3 |
| AS | 0 | 0 | 0 | 0 | 0 | 0 | 0.001 | 0 | 9.4 |
| AT | 0 | 0 | 0.02 | 0 | 0 | 0 | 0 | 0 | 15.5 |
| AU | 0 | 0 | 0.00 | 0 | 0 | 0 | 0 | 0 | 22.2 |

TABLE 1-2-continued

| | | | | | | | | | |
|---|---|---|---|---|---|---|---|---|---|
| AV | 0 | 0 | 0 | 0 | 0 | 0 | 0 | 0 | 18.0 |
| AW | 0 | 0 | 0 | 0 | 0 | 0 | 0 | 0 | 21.7 |
| AX | 0 | 0 | 0 | 0 | 0 | 0 | 0 | 0 | 18.0 |

TABLE 2-1

| | | | AFTER ANNEALING AND TEMPER-ROLLING AND BEFORE HOT STAMPING | | | | | | |
|---|---|---|---|---|---|---|---|---|---|
| STEEL TYPE REFERENCE SYMBOL | TEST REFERENCE SYMBOL | ANNEALING TEMPERATURE (° C.) | TS (Mpa) | EL (%) | λ (%) | TS × EL | TS × λ | FERRITE AREA FRACTION (%) | MARTENSITE AREA FRACTION (%) |
| A | 1 | 790 | 445 | 35.5 | 121 | 15798 | 53845 | 92 | 7 |
| B | 2 | 800 | 468 | 36.2 | 115 | 16942 | 53820 | 87 | 6 |
| C | 3 | 750 | 502 | 31.2 | 132 | 15662 | 66264 | 82 | 10 |
| D | 4 | 790 | 542 | 33.1 | 105 | 17940 | 56910 | 84 | 8 |
| E | 5 | 795 | 542 | 34.8 | 98 | 18862 | 53116 | 78 | 7 |
| F | 6 | 790 | 585 | 26.5 | 86 | 15503 | 50310 | 78 | 6 |
| G | 7 | 745 | 552 | 27.2 | 92 | 15014 | 50784 | 65 | 8 |
| H | 8 | 792 | 622 | 29.1 | 87 | 18100 | 54114 | 88 | 6 |
| I | 9 | 782 | 598 | 28.3 | 93 | 16923 | 55614 | 82 | 9 |
| J | 10 | 771 | 565 | 29.2 | 105 | 16498 | 59325 | 75 | 9 |
| K | 11 | 811 | 635 | 27.1 | 79 | 17209 | 50165 | 78 | 10 |
| L | 12 | 752 | 672 | 30.6 | 89 | 20563 | 59808 | 87 | 7 |
| M | 13 | 782 | 612 | 31.4 | 82 | 19217 | 50184 | 56 | 27 |
| N | 14 | 821 | 631 | 29.6 | 87 | 18678 | 54897 | 58 | 27 |
| O | 15 | 769 | 629 | 28.7 | 89 | 18052 | 55981 | 78 | 13 |
| P | 16 | 781 | 692 | 27.1 | 77 | 18753 | 53284 | 71 | 24 |
| Q | 17 | 781 | 678 | 25.8 | 78 | 17492 | 52884 | 56 | 32 |
| R | 18 | 782 | 672 | 21.5 | 89 | 14448 | 59808 | 63 | 27 |
| S | 19 | 771 | 729 | 23.1 | 79 | 16840 | 57591 | 55 | 32 |
| T | 20 | 785 | 745 | 28.5 | 71 | 21233 | 52895 | 44 | 41 |
| U | 21 | 813 | 761 | 21.6 | 68 | 16438 | 51748 | 44 | 39 |
| W | 22 | 831 | 796 | 19.2 | 65 | 15283 | 51740 | 46 | 37 |
| X | 23 | 815 | 862 | 18.2 | 61 | 15888 | 52582 | 47 | 40 |
| Y | 24 | 802 | 911 | 19.2 | 59 | 17491 | 53749 | 45 | 38 |
| Z | 25 | 841 | 1021 | 13.5 | 55 | 13784 | 56155 | 43 | 41 |

| | AFTER ANNEALING AND TEMPER-ROLLING AND BEFORE HOT STAMPING | | | | PEARLITE AREA |
|---|---|---|---|---|---|
| STEEL TYPE REFERENCE SYMBOL | FERRITE + MARTENSITE AREA FRACTION (%) | RESIDUAL AUSTENITE VOLUME FRACTION (%) | BAINITE AREA FRACTION (%) | PEARLITE AREA FRACTION (%) | FRACTION BEFORE COLD ROLLING (%) |
| A | 99 | 1 | 0 | 0 | 25 |
| B | 93 | 3 | 4 | 0 | 25 |
| C | 92 | 2 | 5 | 1 | 34 |
| D | 92 | 3 | 5 | 0 | 26 |
| E | 85 | 4 | 11 | 0 | 42 |
| F | 84 | 2 | 7 | 7 | 62 |
| G | 73 | 4 | 15 | 8 | 72 |
| H | 94 | 3 | 3 | 0 | 35 |
| I | 91 | 4 | 5 | 0 | 42 |
| J | 84 | 3 | 7 | 6 | 29 |
| K | 88 | 2 | 6 | 4 | 34 |
| L | 94 | 0 | 5 | 1 | 15 |
| M | 83 | 2 | 6 | 9 | 8 |
| N | 85 | 5 | 4 | 6 | 42 |
| O | 91 | 4 | 3 | 2 | 33 |
| P | 95 | 2 | 2 | 1 | 25 |
| Q | 88 | 3 | 5 | 7 | 28 |
| R | 90 | 3 | 7 | 0 | 53 |
| S | 87 | 4 | 9 | 0 | 46 |
| T | 85 | 3 | 12 | 0 | 23 |
| U | 83 | 5 | 9 | 3 | 23 |
| W | 83 | 4 | 10 | 3 | 18 |
| X | 87 | 2 | 6 | 5 | 51 |
| Y | 83 | 2 | 15 | 0 | 43 |
| Z | 84 | 4 | 12 | 0 | 15 |

TABLE 2-2

| STEEL TYPE REFERENCE SYMBOL | TEST REFERENCE SYMBOL | ANNEALING TEMPERATURE (° C.) | AFTER ANNEALING AND TEMPER-ROLLING AND BEFORE HOT STAMPING | | | | | | |
|---|---|---|---|---|---|---|---|---|---|
| | | | TS (Mpa) | EL (%) | λ (%) | TS × EL | TS × λ | FERRITE AREA FRACTION (%) | MARTENSITE AREA FRACTION (%) |
| AA | 26 | 804 | 582 | 27.2 | 76 | 15830 | 44232 | 62 | 8 |
| AB | 27 | 797 | 606 | 27.5 | 68 | 16665 | 41208 | 58 | 13 |
| AC | 28 | 769 | 581 | 27.6 | 79 | 16036 | 45899 | 51 | 9 |
| AD | 29 | 756 | 611 | 21.3 | 66 | 13014 | 40326 | 31 | 15 |
| AE | 30 | 792 | 598 | 24.1 | 75 | 14412 | 44850 | 52 | 9 |
| AF | 31 | 742 | 643 | 27.2 | 71 | 17490 | 45653 | 59 | 21 |
| AG | 32 | 772 | 602 | 29.1 | 62 | 17518 | 37324 | 72 | 17 |
| AH | 33 | 761 | 372 | 40.8 | 117 | 15178 | 43524 | 96 | 0 |
| AI | 34 | 789 | 1493 | 9.1 | 29 | 13586 | 43297 | 9 | 77 |
| AJ | 35 | 768 | 682 | 21.6 | 66 | 14731 | 45012 | 69 | 17 |
| AK | 36 | 802 | 602 | 30.3 | 59 | 18241 | 35518 | 76 | 20 |
| AL | 37 | 789 | 362 | 42.1 | 127 | 15240 | 45974 | 86 | 2 |
| AM | 38 | 766 | 832 | 15.7 | 42 | 13062 | 34944 | 35 | 42 |
| AN | 39 | 802 | 802 | 19.6 | 46 | 15719 | 36892 | 56 | 32 |
| AO | 40 | 816 | 598 | 24.1 | 38 | 14412 | 22724 | 69 | 19 |
| AP | 41 | 779 | 496 | 33.2 | 72 | 16467 | 35712 | 79 | 12 |
| AQ | 42 | 840 | 829 | 20.2 | 32 | 16746 | 26528 | 28 | 61 |
| AR | 43 | 776 | 968 | 14.2 | 39 | 13746 | 37752 | 27 | 63 |
| AS | 45 | 778 | 912 | 16.2 | 45 | 14774 | 41040 | 46 | 32 |
| AT | 46 | 671 | 713 | 15.9 | 51 | 11337 | 36363 | 30 | 10 |
| AU | 47 | 889 | 1023 | 11.3 | 32 | 11560 | 32736 | 2 | 56 |
| AV | 48 | 832 | 956 | 18.1 | 55 | 17304 | 52580 | 44 | 39 |
| AW | 38 | 766 | 832 | 15.7 | 42 | 13062 | 34944 | 35 | 42 |
| AX | 48 | 832 | 956 | 18.1 | 55 | 17304 | 52580 | 44 | 39 |

| STEEL TYPE REFERENCE SYMBOL | AFTER ANNEALING AND TEMPER-ROLLING AND BEFORE HOT STAMPING | | | | PEARLITE AREA FRACTION BEFORE COLD ROLLING (%) |
|---|---|---|---|---|---|
| | FERRITE + MARTENSITE AREA FRACTION (%) | RESIDUAL AUSTENITE VOLUME FRACTION (%) | BAINITE AREA FRACTION (%) | PEARLITE AREA FRACTION (%) | |
| AA | 70 | 2 | 13 | 15 | 25 |
| AB | 71 | 1 | 14 | 14 | 31 |
| AC | 60 | 3 | 17 | 20 | 17 |
| AD | 46 | 1 | 29 | 24 | 42 |
| AE | 61 | 2 | 7 | 30 | 28 |
| AF | 80 | 2 | 8 | 11 | 41 |
| AG | 89 | 2 | 8 | 11 | 21 |
| AH | 96 | 1 | 3 | 0 | 3 |
| AI | 86 | 3 | 1 | 10 | 9 |
| AJ | 86 | 2 | 4 | 8 | 26 |
| AK | 96 | 2 | 2 | 0 | 7 |
| AL | 88 | 1 | 0 | 11 | 15 |
| AM | 77 | 3 | 13 | 7 | 14 |
| AN | 88 | 3 | 9 | 0 | 16 |
| AO | 88 | 4 | 5 | 3 | 16 |
| AP | 91 | 2 | 6 | 1 | 11 |
| AQ | 89 | 0 | 11 | 0 | 22 |
| AR | 90 | 0 | 0 | 10 | 11 |
| AS | 78 | 0 | 18 | 4 | 13 |
| AT | 40 | 1 | 16 | 43 | 40 |
| AU | 58 | 1 | 33 | 8 | 7 |
| AV | 83 | 2 | 13 | 2 | 45 |
| AW | 77 | 3 | 13 | 7 | 14 |
| AX | 83 | 2 | 13 | 2 | 45 |

TABLE 3-1

| STEEL TYPE REFERENCE SYMBOL | AFTER HOT STAMPING | | | | | | | |
|---|---|---|---|---|---|---|---|---|
| | TS (Mpa) | EL (%) | λ (%) | TS × EL | TS × λ | FERRITE AREA FRACTION (%) | MARTENSITE AREA FRACTION (%) | FERRITE + MARTENSITE AREA FRACTION (%) |
| A | 462 | 40.2 | 135 | 18572 | 62370 | 92 | 6 | 98 |
| B | 447 | 41.2 | 125 | 18416 | 55875 | 85 | 7 | 92 |
| C | 512 | 36.2 | 115 | 18534 | 58880 | 83 | 10 | 93 |
| D | 553 | 32.7 | 115 | 18083 | 63595 | 82 | 7 | 89 |
| E | 589 | 32.9 | 99 | 19378 | 58311 | 81 | 6 | 87 |
| F | 589 | 32.1 | 87 | 18907 | 51243 | 82 | 7 | 89 |
| G | 561 | 30.9 | 90 | 17335 | 50490 | 66 | 10 | 76 |
| H | 632 | 30.0 | 89 | 18960 | 56248 | 86 | 8 | 94 |
| I | 698 | 28.3 | 75 | 19753 | 52350 | 65 | 7 | 72 |
| J | 755 | 25.9 | 87 | 19555 | 65685 | 59 | 12 | 71 |
| K | 721 | 24.5 | 72 | 17665 | 51912 | 52 | 22 | 74 |
| L | 752 | 24.2 | 78 | 18198 | 58656 | 53 | 23 | 76 |
| M | 789 | 20.9 | 69 | 16490 | 54441 | 57 | 35 | 92 |
| N | 768 | 19.8 | 72 | 15206 | 55296 | 59 | 27 | 86 |
| O | 802 | 21.2 | 65 | 17002 | 52130 | 41 | 35 | 76 |
| P | 835 | 18.8 | 75 | 15698 | 62625 | 45 | 23 | 68 |
| Q | 872 | 22.5 | 61 | 19620 | 53192 | 41 | 39 | 80 |
| R | 852 | 21.5 | 69 | 18318 | 58788 | 47 | 31 | 78 |
| S | 912 | 20.1 | 56 | 18331 | 51072 | 56 | 32 | 88 |
| T | 965 | 18.5 | 62 | 17853 | 59830 | 41 | 41 | 82 |
| U | 989 | 17.0 | 55 | 16813 | 54395 | 49 | 37 | 86 |
| W | 1025 | 15.9 | 53 | 16298 | 54325 | 46 | 38 | 84 |
| X | 1049 | 17.2 | 49 | 18043 | 51401 | 46 | 37 | 83 |
| Y | 1102 | 14.5 | 51 | 15979 | 56202 | 43 | 40 | 83 |
| Z | 1189 | 13.1 | 55 | 15576 | 65395 | 45 | 48 | 93 |

| STEEL TYPE REFERENCE SYMBOL | AFTER HOT STAMPING | | | |
|---|---|---|---|---|
| | RESIDUAL AUSTENITE VOLUME FRACTION (%) | BAINITE AREA FRACTION (%) | PEARLITE AREA FRACTION (%) | PLATING TYPE *) |
| A | 1 | 0 | 1 | GA |
| B | 3 | 4 | 1 | GI |
| C | 1 | 5 | 1 | GA |
| D | 3 | 8 | 0 | GA |
| E | 1 | 12 | 0 | CR |
| F | 2 | 4 | 5 | GA |
| G | 2 | 14 | 8 | GI |
| H | 4 | 0 | 2 | EG |
| I | 4 | 23 | 1 | GA |
| J | 1 | 25 | 3 | Al |
| K | 1 | 19 | 6 | GA |
| L | 2 | 21 | 1 | CR |
| M | 2 | 6 | 0 | CR |
| N | 5 | 4 | 5 | GA |
| O | 4 | 11 | 9 | GI |
| P | 1 | 31 | 0 | EG |
| Q | 4 | 10 | 6 | Al |
| R | 4 | 13 | 5 | CR |
| S | 4 | 2 | 6 | CR |
| T | 3 | 12 | 3 | GA |
| U | 1 | 13 | 0 | GA |
| W | 4 | 12 | 0 | GA |
| X | 3 | 11 | 3 | GA |
| Y | 1 | 16 | 0 | GI |
| Z | 2 | 5 | 0 | GA |

TABLE 3-2

| STEEL TYPE REFERENCE SYMBOL | AFTER HOT STAMPING | | | | | | | |
|---|---|---|---|---|---|---|---|---|
| | TS (Mpa) | EL (%) | λ (%) | TS × EL | TS × λ | FERRITE AREA FRACTION (%) | MARTENSITE AREA FRACTION (%) | FERRITE + MARTENSITE AREA FRACTION (%) |
| AA | 756 | 19.2 | 63 | 14515 | 47628 | 37 | 39 | 76 |
| AB | 821 | 18.3 | 57 | 15024 | 46797 | 39 | 42 | 81 |
| AC | 891 | 17.6 | 51 | 15682 | 45441 | 32 | 41 | 73 |
| AD | 922 | 16.8 | 41 | 15490 | 37802 | 29 | 38 | 67 |
| AE | 1021 | 15.8 | 31 | 16132 | 31651 | 49 | 31 | 80 |
| AF | 1152 | 13.8 | 38 | 15898 | 43776 | 37 | 42 | 79 |
| AG | 723 | 19.1 | 61 | 13809 | 44103 | 72 | 16 | 88 |
| AH | 412 | 42.1 | 109 | 17345 | 44908 | 97 | 0 | 97 |
| AI | 1513 | 8.3 | 27 | 12558 | 40851 | 6 | 88 | 94 |
| AJ | 821 | 16.9 | 52 | 13875 | 42692 | 57 | 25 | 82 |
| AK | 912 | 18.9 | 43 | 17237 | 39216 | 65 | 32 | 97 |
| AL | 398 | 41.2 | 113 | 16398 | 44974 | 86 | 2 | 88 |
| AM | 1023 | 14.2 | 43 | 14527 | 43989 | 45 | 43 | 88 |
| AN | 923 | 17.6 | 46 | 16245 | 42458 | 57 | 31 | 88 |
| AO | 736 | 19.2 | 41 | 14131 | 30176 | 63 | 26 | 89 |
| AP | 543 | 31.0 | 68 | 16833 | 36924 | 78 | 14 | 92 |
| AQ | 1128 | 14.3 | 34 | 16130 | 38352 | 29 | 63 | 92 |
| AR | 1062 | 12.9 | 35 | 13700 | 37170 | 29 | 65 | 94 |
| AS | 1109 | 13.8 | 41 | 15304 | 45469 | 46 | 32 | 78 |
| AT | 1021 | 11.9 | 38 | 12150 | 38798 | 30 | 28 | 58 |
| AU | 1236 | 9.9 | 34 | 12236 | 42024 | 7 | 69 | 76 |
| AV | 1151 | 13.1 | 46 | 15078 | 52946 | 41 | 44 | 85 |
| AW | 1023 | 14.2 | 43 | 14527 | 43989 | 45 | 43 | 88 |
| AX | 1151 | 13.1 | 46 | 15078 | 52946 | 41 | 44 | 85 |

| STEEL TYPE REFERENCE SYMBOL | AFTER HOT STAMPING | | | |
|---|---|---|---|---|
| | RESIDUAL AUSTENITE VOLUME FRACTION (%) | BAINITE AREA FRACTION (%) | PEARLITE AREA FRACTION (%) | PLATING TYPE *) |
| AA | 2 | 11 | 11 | GA |
| AB | 1 | 6 | 12 | CR |
| AC | 2 | 10 | 15 | GA |
| AD | 1 | 14 | 18 | EG |
| AE | 2 | 7 | 11 | GI |
| AF | 2 | 1 | 18 | Al |
| AG | 2 | 8 | 12 | GI |
| AH | 0 | 3 | 0 | EG |
| AI | 3 | 2 | 1 | Al |
| AJ | 2 | 13 | 3 | GA |
| AK | 2 | 1 | 0 | GA |
| AL | 0 | 1 | 11 | GA |
| AM | 3 | 8 | 1 | GA |
| AN | 3 | 9 | 0 | GI |
| AO | 4 | 7 | 0 | CR |
| AP | 1 | 6 | 1 | GA |
| AQ | 0 | 6 | 2 | GA |
| AR | 0 | 0 | 6 | GA |
| AS | 3 | 14 | 5 | GA |
| AT | 1 | 11 | 30 | GI |
| AU | 4 | 18 | 2 | GI |
| AV | 4 | 10 | 1 | GI |
| AW | 3 | 8 | 1 | CR |
| AX | 4 | 10 | 1 | CR |

TABLE 4-1

| STEEL TYPE REFERENCE SYMBOL | LEFT SIDE OF EXPRESSION (B) BEFORE HOT STAMPING | DETERMI-NATION | LEFT SIDE OF EXPRESSION (B) AFTER HOT STAMPING | DETERMI-NATION | LEFT SIDE OF EXPRESSION (C) BEFORE HOT STAMPING | DETERMI-NATION |
|---|---|---|---|---|---|---|
| A | 1.01 | G | 1.02 | G | 13 | G |
| B | 1.04 | G | 1.02 | G | 17 | G |
| C | 1.05 | G | 1.07 | G | 5 | G |
| D | 1.08 | G | 1.07 | G | 17 | G |

TABLE 4-1-continued

| | | | | | | |
|---|---|---|---|---|---|---|
| E | 1.07 | G | 1.05 | G | 18 | G |
| F | 1.08 | G | 1.09 | G | 12 | G |
| G | 1.08 | G | 1.09 | G | 15 | G |
| H | 1.02 | G | 1.03 | G | 7 | G |
| I | 1.05 | G | 1.04 | G | 8 | G |
| J | 1.05 | G | 1.01 | G | 15 | G |
| K | 1.03 | G | 1.04 | G | 19 | G |
| L | 1.03 | G | 1.02 | G | 14 | G |
| M | 1.08 | G | 1.06 | G | 14 | G |
| N | 1.06 | G | 1.08 | G | 12 | G |
| O | 1.07 | G | 1.08 | G | 13 | G |
| P | 1.04 | G | 1.05 | G | 11 | G |
| Q | 1.04 | G | 1.06 | G | 12 | G |
| R | 1.02 | G | 1.04 | G | 15 | G |
| S | 1.06 | G | 1.05 | G | 16 | G |
| T | 1.09 | G | 1.08 | G | 10 | G |
| U | 1.07 | G | 1.08 | G | 6 | G |
| W | 1.09 | G | 1.08 | G | 7 | G |
| X | 1.06 | G | 1.08 | G | 17 | G |
| Y | 1.04 | G | 1.05 | G | 12 | G |
| Z | 1.06 | G | 1.05 | G | 10 | G |

| STEEL TYPE REFERENCE SYMBOL | LEFT SIDE OF EXPRESSION (C) AFTER HOT STAMPING | DETERMI-NATION | AREA FRACTION OF MnS OF 0.1 μm OR MORE BEFORE HOT STAMPING | AREA FRACTION OF MnS OF 0.1 μm OR MORE AFTER HOT STAMPING |
|---|---|---|---|---|
| A | 15 | G | 0.004 | 0.004 |
| B | 16 | G | 0.006 | 0.005 |
| C | 3 | G | 0.016 | 0.014 |
| D | 15 | G | 0.006 | 0.006 |
| E | 17 | G | 0.006 | 0.007 |
| F | 13 | G | 0.015 | 0.015 |
| G | 12 | G | 0.008 | 0.007 |
| H | 9 | G | 0.006 | 0.005 |
| I | 9 | G | 0.005 | 0.006 |
| J | 14 | G | 0.005 | 0.006 |
| K | 18 | G | 0.005 | 0.006 |
| L | 13 | G | 0.006 | 0.007 |
| M | 15 | G | 0.012 | 0.011 |
| N | 13 | G | 0.003 | 0.003 |
| O | 12 | G | 0.003 | 0.004 |
| P | 10 | G | 0.006 | 0.005 |
| Q | 12 | G | 0.005 | 0.006 |
| R | 15 | G | 0.006 | 0.007 |
| S | 18 | G | 0.008 | 0.008 |
| T | 15 | G | 0.003 | 0.004 |
| U | 5 | G | 0.014 | 0.013 |
| W | 9 | G | 0.006 | 0.007 |
| X | 16 | G | 0.006 | 0.006 |
| Y | 11 | G | 0.006 | 0.004 |
| Z | 9 | G | 0.006 | 0.007 |

TABLE 4-2

| STEEL TYPE REFERENCE SYMBOL | LEFT SIDE OF EXPRESSION (B) BEFORE HOT STAMPING | DETERMI-NATION | LEFT SIDE OF EXPRESSION (B) AFTER HOT STAMPING | DETERMI-NATION | LEFT SIDE OF EXPRESSION (C) BEFORE HOT STAMPING | DETERMI-NATION |
|---|---|---|---|---|---|---|
| AA | 1.13 | B | 1.15 | B | 23 | B |
| AB | 1.15 | B | 1.16 | B | 22 | B |
| AC | 1.13 | B | 1.15 | B | 21 | B |
| AD | 1.19 | B | 1.18 | B | 26 | B |
| AE | 1.13 | B | 1.13 | B | 22 | B |
| AF | 1.11 | B | 1.10 | B | 19 | G |
| AG | 1.16 | B | 1.17 | B | 25 | B |
| AH | — | B | — | B | — | B |
| AI | 1.23 | B | 1.19 | B | 22 | B |
| AJ | 1.23 | B | 1.22 | B | 21 | B |
| AK | 1.19 | B | 1.18 | B | 23 | B |
| AL | — | B | — | B | — | B |
| AM | 1.41 | B | 1.39 | B | 31 | B |
| AN | 1.26 | B | 1.22 | B | 26 | B |
| AO | 1.29 | B | 1.31 | B | 28 | B |
| AP | 1.06 | G | 1.05 | G | 11 | G |
| AQ | 1.19 | B | 1.21 | B | 23 | B |

TABLE 4-2-continued

| | | | | | | |
|---|---|---|---|---|---|---|
| AR | 1.09 | G | 1.07 | G | 17 | G |
| AS | 1.23 | B | 1.21 | B | 23 | B |
| AT | 1.28 | B | 1.26 | B | 27 | B |
| AU | 1.06 | G | 1.07 | G | 18 | G |
| AV | 1.06 | G | 1.07 | G | 18 | G |
| AW | 1.41 | B | 1.39 | B | 31 | B |
| AX | 1.06 | G | 1.07 | G | 18 | G |

| STEEL TYPE REFERENCE SYMBOL | LEFT SIDE OF EXPRESSION (C) AFTER HOT STAMPING | DETERMI-NATION | AREA FRACTION OF MnS OF 0.1 μm OR MORE BEFORE HOT STAMPING | AREA FRACTION OF MnS OF 0.1 μm OR MORE AFTER HOT STAMPING |
|---|---|---|---|---|
| AA | 22 | B | 0.011 | 0.013 |
| AB | 21 | B | 0.008 | 0.007 |
| AC | 20 | B | 0.050 | 0.006 |
| AD | 25 | B | 0.006 | 0.007 |
| AE | 21 | B | 0.009 | 0.009 |
| AF | 18 | G | 0.003 | 0.003 |
| AG | 24 | B | 0.003 | 0.003 |
| AH | — | B | 0.004 | 0.004 |
| AI | 23 | B | 0.006 | 0.006 |
| AJ | 23 | B | 0.007 | 0.008 |
| AK | 22 | B | 0.007 | 0.006 |
| AL | — | B | 0.006 | 0.006 |
| AM | 30 | B | 0.006 | 0.007 |
| AN | 29 | B | 0.008 | 0.009 |
| AO | 33 | B | 0.005 | 0.004 |
| AP | 12 | G | 0.005 | 0.007 |
| AQ | 25 | B | 0.003 | 0.003 |
| AR | 17 | G | 0.002 | 0.002 |
| AS | 23 | B | 0.006 | 0.007 |
| AT | 28 | B | 0.005 | 0.006 |
| AU | 19 | G | 0.006 | 0.005 |
| AV | 19 | G | 0.006 | 0.005 |
| AW | 30 | B | 0.006 | 0.007 |
| AX | 19 | G | 0.006 | 0.005 |

— HARDNESS WAS NOT MEASURED BECAUSE THE AREA FRACTION OF MARTENSITE IS SIGNIFICANTLY SMALL.

TABLE 5-1

| STEEL TYPE REFERENCE SYMBOL | BEFORE HOT STAMPING | | | | AFTER HOT STAMPING | | | | SURFACE PROPERTY AFTER HOT STAMPING | LEFT SIDE OF EXPRESSION (E) | DETERMI-NATION |
|---|---|---|---|---|---|---|---|---|---|---|---|
| | n1 | n2 | LEFT SIDE OF EXPRESSION (D) | DETERMI-NATION | n1 | n2 | LEFT SIDE OF EXPRESSION (D) | DETERMI-NATION | | | |
| A | 10 | 12 | 1.2 | G | 8 | 11 | 1.4 | G | ○ | 1.32 | G |
| B | 6 | 7 | 1.2 | G | 6 | 5 | 0.8 | G | ○ | 1.13 | VG |
| C | 3 | 5 | 1.7 | B | 3 | 5 | 1.7 | B | ○ | 1.23 | G |
| D | 7 | 6 | 0.9 | G | 6 | 6 | 1.0 | G | ○ | 1.29 | G |
| E | 2 | 2 | 1.0 | G | 2 | 2 | 1.0 | G | ○ | 1.51 | G |
| F | 2 | 2 | 1.0 | G | 2 | 2 | 1.0 | G | ○ | 1.23 | G |
| G | 1 | 1 | 1.0 | G | 1 | 1 | 1.0 | G | ○ | 1.43 | G |
| H | 5 | 6 | 1.2 | G | 5 | 5 | 1.0 | G | ○ | 1.10 | VG |
| I | 3 | 4 | 1.3 | G | 4 | 4 | 1.0 | G | ○ | 1.38 | G |
| J | 4 | 4 | 1.0 | G | 4 | 5 | 1.3 | G | ○ | 1.34 | G |
| K | 6 | 7 | 1.2 | G | 7 | 9 | 1.3 | G | ○ | 1.22 | G |
| L | 5 | 7 | 1.4 | G | 5 | 6 | 1.2 | G | ○ | 1.42 | G |
| M | 11 | 20 | 1.8 | B | 11 | 19 | 1.7 | B | ○ | 1.24 | G |
| N | 5 | 6 | 1.2 | G | 6 | 7 | 1.2 | G | ○ | 1.33 | G |
| O | 3 | 3 | 1.0 | G | 3 | 3 | 1.0 | G | ○ | 1.36 | G |
| P | 5 | 6 | 1.2 | G | 5 | 5 | 1.0 | G | ○ | 1.52 | G |
| Q | 8 | 9 | 1.1 | G | 7 | 8 | 1.1 | G | ○ | 1.61 | G |
| R | 16 | 18 | 1.1 | G | 15 | 18 | 1.2 | G | ○ | 1.40 | G |
| S | 11 | 12 | 1.1 | G | 10 | 12 | 1.2 | G | ○ | 1.28 | G |
| T | 6 | 7 | 1.2 | G | 6 | 6 | 1.0 | G | ○ | 1.20 | VG |
| U | 7 | 15 | 2.1 | B | 7 | 14 | 2.0 | B | ○ | 1.41 | G |
| W | 16 | 20 | 1.3 | G | 15 | 19 | 1.3 | G | ○ | 1.07 | VG |
| X | 22 | 26 | 1.2 | G | 22 | 23 | 1.0 | G | ○ | 1.26 | G |
| Y | 22 | 29 | 1.3 | G | 21 | 28 | 1.3 | G | ○ | 1.24 | G |
| Z | 27 | 32 | 1.2 | G | 26 | 32 | 1.2 | G | ○ | 1.55 | G |

TABLE 5-1-continued

| STEEL TYPE REFERENCE SYMBOL | LEFT SIDE OF EXPRESSION (F) | CT | RIGHT SIDE OF EXPRESSION (F) | DETERMI-NATION | TEMPERATURE OF HEATING FURNACE | IN-FURNACE TIME OF HEATING FURNACE (MINUTES) | LEFT SIDE OF EXPRESSION (G) | DETERMI-NATION |
|---|---|---|---|---|---|---|---|---|
| A | 489 | 580 | 768 | G | 1180 | 65 | 5229 | G |
| B | 474 | 650 | 757 | G | 1250 | 72 | 4968 | G |
| C | 354 | 510 | 644 | G | 1154 | 68 | 1968 | G |
| D | 457 | 580 | 728 | G | 1260 | 72 | 4570 | G |
| E | 467 | 615 | 734 | G | 1215 | 116 | 6593 | G |
| F | 410 | 721 | 700 | B | 1322 | 135 | 3302 | G |
| G | 438 | 741 | 729 | B | 1173 | 123 | 4026 | G |
| H | 461 | 585 | 720 | G | 1205 | 95 | 6084 | G |
| I | 450 | 542 | 740 | G | 1189 | 87 | 4331 | G |
| J | 444 | 562 | 701 | G | 1221 | 89 | 3909 | G |
| K | 408 | 715 | 697 | B | 1202 | 95 | 2649 | G |
| L | 404 | 482 | 673 | G | 1212 | 165 | 3267 | G |
| M | 400 | 463 | 692 | G | 1105 | 25 | 1708 | G |
| N | 374 | 502 | 644 | G | 1295 | 195 | 2784 | G |
| O | 407 | 631 | 694 | G | 1240 | 135 | 4004 | G |
| P | 375 | 527 | 640 | G | 1298 | 201 | 2785 | G |
| Q | 410 | 526 | 694 | G | 1192 | 120 | 3252 | G |
| R | 432 | 543 | 727 | G | 1250 | 179 | 4879 | G |
| S | 411 | 554 | 696 | G | 1232 | 122 | 3729 | G |
| T | 363 | 523 | 649 | G | 1232 | 162 | 2630 | G |
| U | 372 | 621 | 650 | G | 1113 | 20 | 1448 | B |
| W | 387 | 521 | 686 | G | 1260 | 125 | 3049 | G |
| X | 393 | 682 | 670 | B | 1180 | 141 | 3360 | G |
| Y | 358 | 482 | 636 | G | 1280 | 162 | 2600 | G |
| Z | 366 | 451 | 651 | G | 1260 | 181 | 2915 | G |

TABLE 5-2

| STEEL TYPE REFERENCE SYMBOL | BEFORE HOT STAMPING | | | | AFTER HOT STAMPING | | | | SURFACE PROPERTY AFTER HOT STAMPING | LEFT SIDE OF EXPRESSION (E) | DETERMI-NATION |
|---|---|---|---|---|---|---|---|---|---|---|---|
| | n1 | n2 | LEFT SIDE OF EXPRESSION (D) | DETERMI-NATION | n1 | n2 | LEFT SIDE OF EXPRESSION (D) | DETERMI-NATION | | | |
| AA | 12 | 13 | 1.1 | G | 12 | 14 | 1.2 | G | ○ | 0.86 | B |
| AB | 10 | 12 | 1.2 | G | 10 | 13 | 1.3 | G | ○ | 0.81 | B |
| AC | 15 | 18 | 1.2 | G | 16 | 19 | 1.2 | G | ○ | 0.69 | B |
| AD | 6 | 8 | 1.3 | G | 6 | 7 | 1.2 | G | ○ | 0.64 | B |
| AE | 12 | 16 | 1.3 | G | 12 | 15 | 1.3 | G | ○ | 0.72 | B |
| AF | 18 | 22 | 1.2 | G | 17 | 22 | 1.3 | G | ○ | 0.98 | B |
| AG | 6 | 7 | 1.2 | G | 5 | 7 | 1.4 | G | ○ | 0.77 | B |
| AH | 4 | 5 | 1.3 | G | 4 | 4 | 1.0 | G | ○ | 1.18 | VG |
| AI | 12 | 15 | 1.3 | G | 12 | 14 | 1.2 | G | ○ | 1.16 | VG |
| AJ | 17 | 21 | 1.2 | G | 15 | 21 | 1.4 | G | ○ | 1.26 | G |
| AK | 12 | 14 | 1.2 | G | 12 | 13 | 1.1 | G | ○ | 1.25 | G |
| AL | 2 | 2 | 1.0 | G | 2 | 2 | 1.0 | G | ○ | 1.16 | VG |
| AM | 16 | 22 | 1.4 | G | 15 | 21 | 1.4 | G | X | 1.26 | G |
| AN | 10 | 12 | 1.2 | G | 10 | 11 | 1.1 | G | ○ | 1.19 | VG |
| AO | 11 | 12 | 1.1 | G | 10 | 11 | 1.1 | G | ○ | 1.08 | VG |
| AP | 7 | 9 | 1.3 | G | 7 | 8 | 1.1 | G | ○ | 1.17 | VG |
| AQ | 13 | 14 | 1.1 | G | 14 | 16 | 1.1 | G | ○ | 1.08 | VG |
| AR | 21 | 26 | 1.2 | G | 22 | 25 | 1.1 | G | ○ | 1.36 | G |
| AS | 18 | 19 | 1.1 | G | 18 | 18 | 1.0 | G | ○ | 1.16 | VG |
| AT | 15 | 17 | 1.1 | G | 16 | 16 | 1.0 | G | ○ | 1.17 | VG |
| AU | 17 | 19 | 1.1 | G | 16 | 18 | 1.1 | G | ○ | 1.39 | G |
| AV | 17 | 19 | 1.1 | G | 16 | 18 | 1.1 | G | Δ | 1.42 | G |
| AW | 16 | 22 | 1.4 | G | 15 | 21 | 1.4 | G | X | 1.25 | G |
| AX | 17 | 19 | 1.1 | G | 16 | 18 | 1.1 | G | Δ | 1.43 | G |

| STEEL TYPE REFERENCE SYMBOL | LEFT SIDE OF EXPRESSION (F) | CT | RIGHT SIDE OF EXPRESSION (F) | DETERMI-NATION | TEMPERATURE OF HEATING FURNACE | IN-FURNACE TIME OF HEATING FURNACE (MINUTES) | LEFT SIDE OF EXPRESSION (G) | DETERMI-NATION |
|---|---|---|---|---|---|---|---|---|
| AA | 442 | 582 | 729 | G | 1210 | 128 | 3865 | G |
| AB | 430 | 535 | 719 | G | 1236 | 116 | 3591 | G |
| AC | 400 | 426 | 692 | G | 1210 | 125 | 2814 | G |
| AD | 436 | 623 | 721 | G | 1210 | 145 | 3604 | G |
| AE | 431 | 611 | 730 | G | 1152 | 152 | 4921 | G |

TABLE 5-2-continued

| | | | | | | | | |
|---|---|---|---|---|---|---|---|---|
| AF | 384 | 396 | 680 | G | 1198 | 86 | 2449 | G |
| AG | 402 | 557 | 696 | G | 1209 | 147 | 3134 | G |
| AH | 413 | 462 | 689 | G | 1209 | 135 | 2339 | G |
| AI | 325 | 476 | 643 | G | 1260 | 165 | 2717 | G |
| AJ | 420 | 543 | 696 | G | 1230 | 98 | 3269 | G |
| AK | 435 | 558 | 687 | G | 1211 | 156 | 5054 | G |
| AL | 481 | 721 | 777 | G | 1180 | 161 | 16656 | G |
| AM | 248 | 539 | 546 | G | 1291 | 332 | 1602 | G |
| AN | 401 | 560 | 667 | G | 1219 | 135 | 3134 | G |
| AO | 396 | 523 | 673 | G | 1266 | 173 | 2694 | G |
| AP | 443 | 551 | 724 | G | 1230 | 125 | 3378 | G |
| AQ | 363 | 402 | 648 | G | 1250 | 140 | 2605 | G |
| AR | 371 | 432 | 649 | G | 1241 | 192 | 3115 | G |
| AS | 398 | 630 | 695 | G | 1263 | 191 | 3540 | G |
| AT | 384 | 669 | 682 | G | 1203 | 203 | 3026 | G |
| AU | 365 | 456 | 664 | G | 1248 | 192 | 2697 | G |
| AV | 360 | 456 | 658 | G | 1248 | 192 | 2571 | G |
| AW | 248 | 539 | 546 | G | 1291 | 332 | 1602 | G |
| AX | 360 | 456 | 658 | G | 1248 | 192 | 2571 | G |

Based on the above-described examples and comparative examples, it is found that, as long as the conditions of the present invention are satisfied, it is possible to obtain a cold-rolled steel sheet, a galvanized cold-rolled steel sheet, a galvannealed cold-rolled steel sheet, a electrogalvanized cold-rolled steel sheet, or a alluminized cold-rolled steel sheet all of which satisfy TS×λ; 50000 MPa·% even after hot stamping, and a hot-stamped steel manufactured from the obtained cold-rolled steel sheet.

INDUSTRIAL APPLICABILITY

Since the cold-rolled steel sheet and the hot-stamped steel which are obtained in the present invention can satisfy TS×λ≥50000 MPa·% after hot stamping, the cold-rolled steel sheet and the hot-stamped steel have a high press workability and a high strength, and satisfies the current requirements for a vehicle such as an additional reduction of the weight and a more complicated shape of a component.

| Brief Description of the Reference Symbols |
|---|
| S1: MELTING STEP |
| S2: CASTING STEP |
| S3: HEATING STEP |
| S4: HOT-ROLLING STEP |
| S5: COILING STEP |
| S6: PICKLING STEP |
| S7: COLD-ROLLING STEP |
| S8: ANNEALING STEP |
| S9: TEMPER-ROLLING STEP |
| S10: GALVANIZING STEP |
| S11: ALLOYING STEP |
| S12: ALUMINIZING STEP |
| S13: ELECTROGALVANIZING STEP |

What is claimed is:

1. A hot-stamped steel comprising, by mass %:

C: 0.030% to 0.150%;

Si: 0.010% to 1.000%;

Mn: 0.50% or more and less than 1.50%;

P: 0.001% to 0.060%;

S: 0.001% to 0.010%;

N: 0.0005% to 0.0100%;

Al: 0.010% to 0.050%, and optionally at least one of

B: 0.0005% to 0.0020%;

Mo: 0.01% to 0.50%;

Cr: 0.01% to 0.50%;

V: 0.001% to 0.100%;

Ti: 0.001% to 0.100%;

Nb: 0.001% to 0.050%;

Ni: 0.01% to 1.00%;

Cu: 0.01% to 1.00%;

Ca: 0.0005% to 0.0050%;

REM: 0.0005% to 0.0050%, and a balance of Fe and impurities, wherein when [C] is an amount of C by mass %, [Si] is an amount of Si by mass %, and [Mn] is an amount of Mn by mass %, a following expression (A) is satisfied, the structure of the hot-stamped steel sheet consists of a ferrite, a martensite, and optionally one or more of a pearlite, a retained austenite, and a bainite, an area fraction of the ferrite is 40% to 95% and an area fraction of the martensite is 5% to 60%, a total of the area fraction of the ferrite and the area fraction of the martensite is 60% or more, an area fraction of the pearlite is 10% or less, a volume fraction of the retained austenite is 5% or less, and an area fraction of the bainite is less than 40%, a hardness of the martensite measured with a nanoindenter satisfies a following expression (B) and a following expression (C), TS×λ which is a product of a tensile strength TS and a hole expansion ratio λ is 50000 MPa·% or more, $$(5\times[Si]+[Mn])/[C]>10 \quad \text{(A)},$$

$$H2/H1<1.10 \quad \text{(B)},$$

$$\sigma HM<20 \quad \text{(C), and}$$

the H1 is an average hardness of the martensite in a surface portion of a sheet thickness of the hot-stamped steel, the surface portion is an area having a width of 200 μm in a thickness direction from an outermost layer, the H2 is an average hardness of the martensite in a central portion of the sheet thickness of the hot-stamped steel, the central portion is an area having a width of 200 μm in the thickness direction at a center of the sheet thickness, and the σHM is a variance of the average hardness of the martensite in the central portion of the sheet thickness of the hot-stamped steel.

2. The hot-stamped steel according to claim 1, wherein an area fraction of MnS existing in the hot-stamped steel and having an equivalent circle diameter of 0.1 μm to 10 μm is 0.01% or less, a following expression (D) is satisfied, $$n2/n1<1.5 \quad \text{(D), and}$$

the n1 is an average number density per 10000 $\mu m^2$ of the MnS having an equivalent circle diameter of 0.1 μm to 10 μm in a ¼ portion of the sheet thickness of the hot-stamped steel, and the n2 is an average number density per 10000 $\mu m^2$ of the MnS having an equivalent circle diameter of 0.1 μm to 10 μm in the central portion of the sheet thickness of the hot-stamped steel.

3. The hot-stamped steel according to claim 1, wherein a hot-dip galvanized layer is formed on a surface thereof.

4. The hot-stamped steel according to claim 3, wherein the hot-dip galvanized layer is alloyed.

5. The hot-stamped steel according to claim 1, wherein an electrogalvanized layer is formed on a surface thereof.

6. The hot-stamped steel according to claim 1, wherein an aluminized layer is formed on a surface thereof.

* * * * *